US010777086B2

(12) United States Patent
Barker

(10) Patent No.: US 10,777,086 B2
(45) Date of Patent: Sep. 15, 2020

(54) METHOD FOR DETECTING CONFLICTS BETWEEN AIRCRAFT

(71) Applicant: VIA TECHNOLOGY LTD, New Milton, Hampshire (GB)

(72) Inventor: Kenneth Frederick Miles Barker, New Milton (GB)

(73) Assignee: Via Technology Ltd, New Milton, Hampshire (GB)

( * ) Notice: Subject to any disclaimer, the term of this patent is extended or adjusted under 35 U.S.C. 154(b) by 243 days.

(21) Appl. No.: 15/742,951

(22) PCT Filed: Jun. 30, 2016

(86) PCT No.: PCT/GB2016/051965
§ 371 (c)(1),
(2) Date: Jan. 9, 2018

(87) PCT Pub. No.: WO2017/013387
PCT Pub. Date: Jan. 26, 2017

(65) Prior Publication Data

US 2019/0012925 A1 Jan. 10, 2019

(30) Foreign Application Priority Data

Jul. 22, 2015 (GB) ..... 1512909.1

(51) Int. Cl.
*G08G 5/04* (2006.01)
*G08G 5/00* (2006.01)

(52) U.S. Cl.
CPC ..... *G08G 5/045* (2013.01); *G08G 5/0013* (2013.01); *G08G 5/0026* (2013.01);
(Continued)

(58) Field of Classification Search
CPC .... G08G 5/045; G08G 5/0043; G08G 5/0013; G08G 5/0026; G08G 5/0039; G08G 5/0091; G08G 5/0082; G01S 13/9303
See application file for complete search history.

(56) References Cited

U.S. PATENT DOCUMENTS 4,839,658 A 6/1989 Kathol et al.
6,314,362 B1 * 11/2001 Erzberger ..... G08G 5/0043 340/961

(Continued)

FOREIGN PATENT DOCUMENTS

| | | |
|---|---|---|
| EP | 2 372 672 | 10/2011 |
| EP | 2 667 365 | 11/2013 |
| GB | 2 502 866 | 12/2013 |

OTHER PUBLICATIONS

International Search Report and Written Opinion of the ISA for PCT/GB2016/051965, dated Oct. 7, 2016, 15 pages.

(Continued)

*Primary Examiner* — Behrang Badii
*Assistant Examiner* — Daniel L Greene
(74) *Attorney, Agent, or Firm* — Nixon & Vanderhye P.C.

(57) ABSTRACT

A method for detecting conflicts between aircraft flying in controlled airspace. The method determines whether pairs of aircraft flight routes violate a predetermined proximity test. The separation of pairs of aircraft whose flight routes do not violate the proximity test is assured. For pairs of aircraft whose flight routes violate the proximity test, the method calculates the parts of their flight routes that breach the separation threshold, the conflict paths (406, 408). The conflict paths are stored. The method determines the portions of aircraft trajectories corresponding to the conflict paths. The separation of aircraft that have flown past their conflict paths is assured. The separation time and separation altitude of pairs of aircraft that have not flown past their (Continued)

conflict paths are calculated. The separation time and separation altitude are used to determine future circumstances whereby the pairs of aircraft may lose separation.

20 Claims, 19 Drawing Sheets

(52) U.S. Cl.
CPC ..... *G08G 5/0039* (2013.01); *G08G 5/0043* (2013.01); *G08G 5/0082* (2013.01); *G08G 5/0091* (2013.01)

(56) References Cited

U.S. PATENT DOCUMENTS 6,420,993 B1 7/2002 Varon
6,507,782 B1 * 1/2003 Rumbo ..... G05D 1/0005 244/182
7,702,427 B1 * 4/2010 Sridhar ..... G08G 5/045 701/14
9,997,080 B1 * 6/2018 Chambers ..... G08G 5/045
2003/0222795 A1 * 12/2003 Holforty ..... B64D 43/00 340/968
2004/0024527 A1 2/2004 Patera
2008/0174454 A1 * 7/2008 Bitar ..... G01C 21/00 340/975
2009/0005960 A1 * 1/2009 Roberts ..... G08G 5/0026 701/120
2009/0012660 A1 * 1/2009 Roberts ..... G08G 5/0013 701/3
2010/0211302 A1 8/2010 Ribbe et al.
2010/0228468 A1 * 9/2010 D'Angelo ..... G08G 5/0008 701/120
2011/0118980 A1 * 5/2011 Hoy ..... G01S 13/867 701/301
2011/0298648 A1 * 12/2011 Ferro ..... G08G 5/0078 342/29
2012/0083946 A1 * 4/2012 Maldonado ..... G06Q 10/06 701/3
2012/0303253 A1 * 11/2012 Irfan ..... G08G 5/0026 701/120
2016/0275801 A1 * 9/2016 Kopardekar ..... G08G 5/0043
2016/0343258 A1 * 11/2016 Navarro ..... G08G 5/0052

OTHER PUBLICATIONS

Combined Search and Examination Report for GB 1512909.1, dated Aug. 28, 2015, 9 pages.
Isaacson et al. "Design of a Conflict Detection Algorithm for the Center/TRACON Automation System", NASA Ames Research Center, Digital Avionics Systems Conference, vol. 2, Oct. 26, 1997, 9 pages.
Alonso-Ayuso et al. "Exact and Approximate Solving of the Aircraft Collision Resolution Problem via Turn Changes", Transportation Science, vol. 50, No. 1, Feb. 2016, 13 pages.
Dunlay "Analytical Models of Perceived Air Traffic Control Conflict", Transportation Science, The University of Austin Texas, vol. 9, No. 2, May 1975, 17 pages.
Geisinger "Airspace Conflict Equations", Transportation Science, May 1985, vol. 19, No. 2, 16 pages.
Siddiqee "A Mathematical Model for Predicting the No. Of Potential Conflict Situations at Intersecting Air Routes" Transportation Science, vol. 7, No. 2, May 1973, 11 pages.
Willermain "Factors Influencing Blind Conflict Risk in En Route Sectors Under Free-Flight Conditions" Transportation Science, vol. 37, No. 4, Nov. 2003, 15 pages.

* cited by examiner

METHOD FOR DETECTING CONFLICTS BETWEEN AIRCRAFT

This application is the U.S. national phase of International Application No. PCT/GB2016/051965 filed Jun. 30, 2016, which designated the U.S. and claims priority to GB Patent Application No. 1512909.1 filed Jul. 22, 2015, the entire contents of each of which are hereby incorporated by reference.

The present technique relates to a computer implemented method for detecting conflicts between aircraft, an air traffic control system, and a computer program.

An air traffic control (ATC) system is responsible for assuring the safe and expeditious movement of air traffic through its airspace and contiguous areas, by assuring that all aircraft are separated from each other at all times. A conflict is an event in which two or more aircraft experience a loss of minimum separation between the positions which the aircraft are expected to be at a given time. The minimum separation or separation requirement may be based on a measurements criteria or based on the probability of conflict. If a conflict is detected between a pair of aircraft, then the air traffic controller using the system can decide what action to take. An air traffic control system uses trajectories to predict the separation of the aircraft. An aircraft trajectory contains predicted positions of the aircraft. The predicted positions are four dimensional (time, horizontal position and vertical position) and include tolerances corresponding to a predefined level of confidence in each position.

To assure the separation of all aircraft, all combinations of aircraft pairs are considered. For n aircraft there are $n(n-1)/2$ combinations of aircraft pairs. This is the essential problem of conflict detection: the number of combinations of aircraft pairs increases with the square of the number of aircraft. The number of combinations can be controlled by limiting the size of the airspace and/or the duration of the look-ahead period. However, these limits also limit the potential benefits of conflict detection. The computationally intensive nature of conventional conflict detection algorithms limits their use in current real-time air traffic control systems to small volumes of airspace with short look-ahead periods.

The invention is defined in the appended claims.

At least some examples provide a computer implemented method for detecting conflicts between a plurality of aircraft comprising: identifying flight routes for the plurality of aircraft; identifying one or more conflict paths based on the identified flight routes, wherein a conflict path comprises a portion of a flight route which has a horizontal separation from another flight route less than a predetermined horizontal distance; performing conflict detection using portions of predicted trajectories for the plurality of aircraft corresponding to positions within the one or more conflict paths. Each trajectory comprises predicted timings at which the aircraft is predicted to be situated at respective positions. The conflict paths are identified independent of the predicted trajectories of the aircraft.

Aircraft intending to fly through a controlled airspace are normally required to file a flight plan, including an intended flight route for the aircraft. Based on the flight routes for a plurality of aircraft, one or more conflict paths can be identified which represent regions where the horizontal separation between two flight routes is less than a predetermined horizontal distance. Hence, the locations along a flight route where conflicts may occur can be determined without considering the timings or trajectories of the aircraft, which are typically more volatile and updated more regularly than flight routes. As this determination of the conflict paths is trajectory independent, the conflict paths can be determined relatively quickly and do not need to be re-calculated each time the trajectories change.

Having identified the conflict paths, subsequent conflict detection can be performed using portions of the predicted aircraft trajectories which correspond to the conflict paths. The regions of the flight routes outside the conflict paths have a horizontal separation greater than the predetermined distance and so separation can be assured here, so it is not necessary to perform the trajectory-based conflict detection for positions outside the conflict paths. The conflict detection using the predicted trajectories is typically more computationally intensive because it may often involve a series of comparisons between aircraft positions and timings at a series of points along the predicted trajectories. By identifying the conflict paths based on the flight routes and using the identified conflict paths to perform more targeted analysis of portions of the aircraft trajectories, the speed of computation for a given number of aircraft can be substantially quicker than existing methods.

By reducing the computational complexity of analysing conflicts between aircraft, this also allows conflicts to be detected for larger sectors and allows the look-ahead period to be increased. There are also subsequent benefits in routing of aircraft. Faster computation and earlier detection of conflicts may avoid an air traffic controller having to instruct an aircraft to make last minute deviations. Also, aircraft can more frequently be routed direct, thus reducing the fuel consumption for a given flight and reducing environmental emissions.

The identification of conflict paths can also provide a further advantage because the entry or exit points of the conflict paths can provide reference points for determining other information useful for air traffic control, for example the time by which a pair of aircraft may be separated or in conflict and the earliest time when separation may be lost, which can be useful for determining how to resolve the conflicts that are identified and determining knock on effects of resolving one conflict on other aircraft. The conflict paths can provide a more useful reference fix for such timing calculations than arbitrary way points along the aircraft trajectories. Most air traffic control tools (e.g. departure managers, arrival managers, etc.) are time based, so this also makes it easier to integrate the conflict detection system with other air traffic control tools.

At least a portion of the predicted trajectories corresponding to positions outside the one or more conflict paths may be eliminated from the conflict detection. Eliminating portions of the predicted trajectories corresponding to positions outside the one or more conflict paths from conflict analysis reduces the amount of trajectory data that needs to be processed thereby increasing the computational speed of the method. In some embodiments, only portions of the predicted trajectories corresponding to conflict paths are considered in the conflict detection. In other embodiments, for safety a margin outside the conflict paths could also be considered, so that the portions of the trajectories that are analysed in the conflict detection include not only the portions corresponding to the conflict paths themselves, but also a portion either side of the conflict paths. Nevertheless, by eliminating from the conflict detection portions of the trajectories which lie far from the conflict paths (and so the separation of the aircraft at these positions can be assured with any other aircraft flying on the other identified flight routes), the amount of computation can be reduced significantly.

At least part of the method of identifying of the conflict paths and at least part of the method of conflict detection may be repeated when a new aircraft or an updated flight route for an existing aircraft is identified. Also, at least part of the conflict detection may be repeated when a predicted trajectory of an aircraft is updated. Hence, the method can be an ongoing process where the identification of conflict paths and the conflict detection is continually repeated as more information comes in about the intended flight routes of the aircraft in a given airspace and their predicted trajectories.

At least one hazarding pair of aircraft may be identified for which the flight routes for that hazarding pair of aircraft have hazarding conflict paths separated by a horizontal separation less than a predetermined horizontal distance. This allows an aircraft to be paired with other aircraft which have corresponding conflict paths along their flight routes. Any aircraft not identified in a hazarding pair of aircraft may be reported as meeting the separation requirement and/or eliminated from subsequent conflict detection, reducing the amount of data that needs to be processed. The comparison of the predicted trajectories can be restricted to those pairs of aircraft with hazarding conflict paths, so this can greatly reduce the number of combinations of aircraft whose trajectories need to be compared, reducing the computational complexity and increasing the speed of calculation.

It may be determined that a separation requirement is satisfied between a given hazarding pair of aircraft when one of the given hazarding pair of aircraft has traveled beyond a corresponding one of the hazarding conflict paths. Once one of the hazarding pair of aircraft has traveled beyond a corresponding one of the hazarding conflict paths, the hazarding pair of aircraft of aircraft cannot occupy the hazarding pair of conflict paths simultaneously, and therefore it can be determined a separation requirement is satisfied between the hazarding pair of aircraft, without actually needing to compare the trajectories of the hazarding pair of aircraft. This further reduces the number of pairs of aircraft whose trajectories need to analysed in more detail.

A given hazarding pair of aircraft may be eliminated from subsequent conflict detection when one of the given hazarding pair of aircraft has traveled beyond the corresponding one of the hazarding conflict paths. By eliminating a given hazarding pair of aircraft from subsequent conflict detection, the number of hazarding pairs of aircraft that need to be analysed reduces which in turn increases the speed of calculation.

The conflict detection may comprise comparing predicted timings at which a given hazarding pair of aircraft are expected to be at positions corresponding to the hazarding conflict paths. Again, restricting the timing comparisons to portions of the trajectories corresponding to the hazarding conflict paths can greatly reduce the computational workload in determining whether there are conflicts between aircraft. It is not necessary to consider other portions of the trajectories since there is sufficient horizontal separation between the hazarding pair of aircraft at other portions of the predicted trajectories not corresponding to conflict paths.

A given hazarding pair of aircraft may be determined as meeting the separation requirement (and may also be eliminated from subsequent conflict detection) when they are not expected to occupy their corresponding hazarding conflict paths simultaneously. Hence, if the ranges of times at which the hazarding pair of aircraft are predicted to occupy their conflict paths are separated (do not overlap), separation can be assured without needing to consider the trajectories of those aircraft further.

A time separation between the predicted timings at which the given hazarding pair of aircraft are expected to be at positions corresponding to the hazarding conflict paths may be determined. The time separation may indicate an amount of time by which the predicted timings of one of the hazarding pair of aircraft would need to change to cause or avoid loss of separation. That is, the time separation can provide a quantitative measure of how close a pair of aircraft come to losing separation (in the case of aircraft predicted to meet the separation requirement), or how much the trajectory timings of one of the pair of aircraft would need to change to regain separation (in the case of aircraft predicted to lose separation) which can be useful for helping an air traffic controller decide whether to alter the speed of, or delay, one of the aircraft, and by how much. The time separation can also be a useful measure for analysing the knock-on effect of resolving a short term conflict between one hazarding pair of aircraft on other longer term conflicts they may be involved in. The time separation also enables the conflict detection system to integrate better with other air traffic control tools such as arrival/departure managers which are time based, unlike conventional conflict detectors.

The time separation can be determined in different ways depending on the relative direction of travel, relative speeds of the hazarding pair of aircraft, and whether the faster or slower aircraft enters the corresponding conflict path first. Some examples are discussed in the description below.

It may be determined that a separation requirement is satisfied between the given hazarding pair of aircraft when the time separation is greater than a first predetermined time threshold.

A given hazarding pair of aircraft may be eliminated from subsequent conflict detection when the time separation is greater than a first predetermined time threshold. By eliminating a given hazarding pair of aircraft from subsequent conflict detection, the number of hazarding pair of aircraft that need to be analysed reduces which in turn increases the speed of calculation.

A warning indication may be outputted for a given pair of hazarding aircraft when the time separation is less than a second predetermined time threshold. This alerts and draws the attention of the air traffic controller or operator of the method to pairs of aircraft which have a time separation less than a second predetermined time threshold, allowing them to identify potential conflicts more easily and take corrective action sooner. The warning indication could for example be a visual indication (e.g. a flashing light, or a display of a symbol or some text to indicate that the time separation is too small), or an audible indication such as a buzzer sounding.

In some cases the first predetermined time threshold (beyond which hazarding pairs of aircraft are eliminated from further analysis) may be the same as the second predetermined time threshold (used to identify the pairs of aircraft for which warning indications should be output as there is a risk of conflict). For example, the threshold could be zero, or non-zero to provide a safety margin.

However, in other embodiments the first predetermined time threshold may be greater than the second predetermined time threshold, so that some pairs of aircraft may not be eliminated from the subsequent conflict analysis but also do not trigger the warning indication. For safety it may still be preferable to continue analysing pairs of aircraft whose time separation lies between the first and second time thresholds in case their predicted time separation subsequently decreases (e.g. due to changes in the aircraft trajectories due to changes in weather conditions or aircraft performance for example).

An indication of the time separation determined for at least one hazarding pair of aircraft may be displayed. Time separation is a particularly useful measure of risk as it accounts for the direction and speed of travel of the aircraft as well as their relative positions.

A graphical representation of the time separation determined for at least one hazarding pair of aircraft may be displayed. For example, indications of hazarding pairs of aircraft could be colour coded or marked with different symbols depending on the amount of time separation between the expected timings at which the aircraft occupy the conflict paths. This can help the air traffic controller to determine which pairs of aircraft pose the greatest risk.

The graphical representation may comprise a graph in which one or more points representing said at least one hazarding pair of aircraft are plotted against a first axis representing the time separation and a second axis representing an expected timing at which one of the hazarding pair of aircraft is expected to be at a corresponding one of the hazarding conflict paths. This allows the air traffic controller or operator of the method to visualise the separation between multiple pairs of aircraft more easily, allowing them to easily determine which hazarding pair of aircraft require corrective action in order to avoid conflict.

The determination of the time separation for said at least one hazarding pair of aircraft may be repeated and the display may be updated to reflect the changes in time separation over time. This allows the air traffic controller or operator of the method to visualise the how the separation between multiple pairs of aircraft is changing with each repeating of the method. This allows them to identify hazarding pairs of aircraft which may require corrective action before their corresponding time separation decreases below the second predetermined time threshold, increasing air traffic safety. By monitoring how the time separations for pairs of aircraft change over time, the accuracy of the predictions can be determined. For example, time separation for a given pair of aircraft would usually be expected to increase over time, as uncertainty in the trajectory timings decreases. Hence, decreasing time separation for a given pair of aircraft can be an indication that there has been an error in the predictions for that pair of aircraft.

A rate of change of the time separation over time may be determined. The rate of change of time separation is a good indication of the way in which a conflict situation is changing and evolving.

An indication of the rate of change of the time separation may be displayed (e.g. as a numerical value or in a graphical representation such as using colours or symbols to signal the amount of rate of change of time separation). The air traffic controller or operator of the method is then able easily identify hazarding pairs of aircraft which have a reducing time separation and may be at a higher risk of conflict.

Other timing information can also be determined based on the conflict paths. For example, the conflict detection may include determining an earliest time at which separation may be lost between a given hazarding pair of aircraft. This can be determined based on the time at which the leading aircraft of the hazarding pair is expected to enter its corresponding conflict path. Also, the conflict detection may include determining a duration of a period when separation between a given hazarding pair of aircraft may be lost. These can provide useful indications for assisting the air traffic controller in resolving potential conflicts.

The conflict detection may comprise determining a vertical separation of the predicted trajectories of a given hazarding pair of aircraft at positions corresponding to the hazarding conflict paths. Determining the vertical separation at positions corresponding to the hazarding conflict paths reduces the computational burden of the method as only portions of the predicted trajectories corresponding to the hazarding conflict paths need to be analysed since there is sufficient horizontal separation between the hazarding pair of aircraft at other portions of the predicted trajectories not corresponding to the conflict paths.

Again, there may be a coarse separation of the ranges of altitudes at which a hazarding pair of aircraft are expected to reside within the corresponding conflict paths, and if there is the required separation between the altitude ranges for the pair of aircraft, then the separation requirement may be determined to be satisfied.

It may be determined that a separation requirement is satisfied between the given hazarding pair of aircraft when the vertical separation is greater than a predetermined vertical distance. As there is sufficient horizontal separation between the hazarding pair of aircraft at portions of the predicted trajectories outside of the hazarding conflict paths, then if the vertical separation between a hazarding pair of aircraft at portions of the predicted trajectories corresponding to the hazarding conflict paths is sufficiently large then it can be determined that a separation requirement is satisfied between the hazarding pair of aircraft.

A given hazarding pair of aircraft may be eliminated from subsequent conflict detection when the vertical separation is greater than a predetermined vertical distance. By eliminating a given hazarding pair of aircraft from subsequent conflict detection, the number of hazarding pair of aircraft that need to be analysed reduces which in turn increases the speed of calculation.

The conflict paths may be identified in a number of different ways. In some cases, identifying the conflict paths may comprise actually comparing the horizontal positions of the flight routes to determine the portions of the routes which are separated by less than the predetermined horizontal distance.

In some examples, identifying the conflict paths may comprise looking up pairs of identified flight routes in a database which specifies conflict paths for each pair of flight routes. Some aircraft may follow one of a number of pre-set flight routes and there may be several flights per day following the same routes (e.g. a number of scheduled flights between a given pair of airports), and so a database specifying the conflict paths for respective pairs of flight routes may be maintained, and then when considering conflicts between a given set of aircraft the flight routes of each respective pair of aircraft can simply be looked up in the pre-prepared database. This increases the speed of calculation as the actual horizontal positions of pairs of identified flight routes do not need to be re-analysed each time the conflict detection method is performed.

Some systems may also use a combination of these techniques, with conflict paths for some pairs of routes being looked up in the database, and conflict paths for routes which are not in the database being determined on the fly by comparing the horizontal positions of the routes. For example, some flight routes may be a unique collection of waypoints which would not be logged in the database, so for such routes the horizontal positions of the routes may be compared with horizontal positions of other routes to identify the corresponding conflict paths. At least some examples provide a computer implemented method comprising: identifying a plurality of aircraft flight routes; comparing the aircraft flight routes to identity conflict paths, wherein a conflict path comprises a portion of an aircraft flight route which has a horizontal separation from another aircraft flight route less than a predetermined horizontal distance; and storing, for one or more pairs of aircraft flight routes, one or more conflict paths identified for each pair.

By determining conflict paths which represent regions where the horizontal separation between flight routes is less than a predetermined horizontal distance, locations along a flight route where conflict may occur can be determined without considering the timings or trajectories of the aircraft. Storing an indication of one or more conflict paths identified allows known conflict paths to be retrieved for future conflict detection. Hence, this method can be performed upfront ahead of the time when the conflicts between aircraft are actually being detected, or could be performed during conflict detection itself.

The flight routes may be defined in different ways for different embodiments. In some cases, a flight route may comprise a series of one or more zero-width routes. Hence, each flight route may effectively comprise coordinates defining a series of dot-to-dot routes along which an aircraft is nominally expected to travel. In practice, the aircraft will not follow the zero-width routes exactly and may only need to remain within a certain amount of navigational tolerance of the nominal flight route. Therefore, when comparing the horizontal positions of the flight routes to identify the conflict paths, the predetermined horizontal distance may factor in an expected navigational tolerance (representing how close an aircraft is expected to be to the nominal route). For instance, the predetermined horizontal distance could correspond to twice the expected navigational tolerance (one for each aircraft) plus an additional safety margin required for separation.

Alternatively, a flight route may comprise a series of one or more corridors within which the aircraft is expected to be positioned during the flight of the aircraft. Considering each flight route as a series of one or more corridors allows the navigational tolerances of the aircraft to be applied to the flight route, so that the comparison of horizontal positions of the flight routes could merely consider whether the separation between the boundaries of the corridors is greater than the predetermined horizontal distance specified for safe separation, without needing to consider navigational tolerances during the identification of the conflict paths.

At least part of the comparing and storing steps may be repeated when a new aircraft flight route or an update to an existing aircraft flight route is identified. Hence, the stored indications of conflict paths can be continually updated to reflect the latest set of flight routes along which aircraft may travel.

The storing step may comprise updating a database specifying one or more conflict paths for each pair of aircraft flight routes. This database could then be accessed when performing the conflict detection method discussed above. Note that while the database may specify the conflict paths for each possible pair of flight routes along which aircraft could fly, when performing the subsequent conflict detection method for a specific set of aircraft, only some of the flight routes are looked up and so the number of conflict paths identified and subsequently analysed in the conflict detection is smaller.

At least some examples provide an air traffic control system comprising processing circuitry and a data store for storing instructions for controlling the processing circuitry to perform a conflict detection method. The system could be dedicated solely for air traffic control or could be a general purpose computer which is also used for other purposes.

At least some examples provide a computer program which controls a computer to perform a conflict detection method.

At least some examples provide a computer-readable storage medium which stores a computer program for controlling a computer to perform a conflict detection method.

The term "aircraft" is intended to encompass any flying vehicle, including an aeroplane (airplane), helicopter, glider, microlite, etc. However, in some embodiments, the aircraft comprise aeroplanes.

Various embodiments of the invention will now be described in detail by way of example only with reference to the following drawings.

An air traffic control system is responsible for assuring the safe and expeditious movement of air traffic through its airspace and contiguous areas, by assuring that all aircraft are separated from each other at all times. An automated conflict detection method and system may be provided for identifying conflicts between aircraft for which loss of separation is predicted to occur. A human air traffic controller can use the information provided by the conflict detection to determine how to resolve the conflicts. Hence, it will be appreciated that the conflict detection method discussed below need not include any steps for resolving identified conflicts this may be the responsibility of the air traffic controller. The conflict detection method may merely identify which pairs of aircraft conflict and/or provide information concerning the separation of that pair of aircraft, to enable the air traffic controller to decide how to deal with the conflict (e.g. by rerouting an aircraft, or instructing one or both of the aircraft to change time, route, heading, altitude or speed).

Alternatively, the conflict detection method can be used in an automated air traffic control conflict resolution system which can not only identify the conflicts which may arise, but also determine how to resolve the identified conflicts and instruct one or more aircraft to change time, route, heading, altitude or speed, without requiring the input of a human air traffic controller (although a human controller may still be able to intervene if required).

Figure 1:
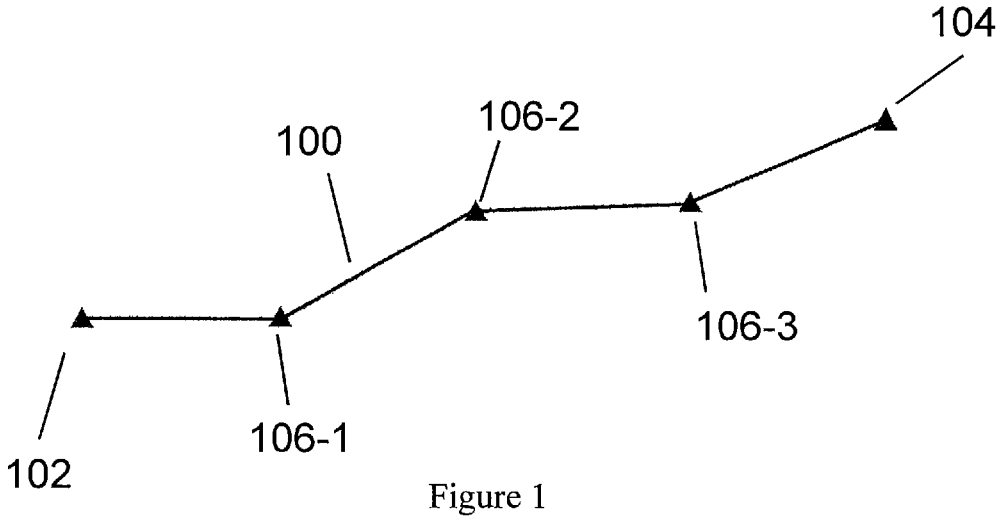
FIG. 1 is a schematic diagram of a first example of a flight route.

An aircraft intending to fly through controlled airspace is required to file a flight plan. The flight plan includes the route that the aircraft intends to fly, referred to as the flight route. FIG. 1 illustrates an example of a flight route 100. Flight route 100 may be a series of one or more zero-width routes. A route is referred to as being zero-width when the flight route has a negligible width. The start point 102 of flight route 100 is a point with a known latitude and longitude. The start point 102 may represent a point, such as the departure point for the route, the entry point of the route into controlled airspace or a sector within the controlled airspace. The end point 104 of flight route 100 is another point with a known latitude and longitude. The end point 104 may represent a point, such as an arrival point for the route, the exit point of the route out of controlled airspace or a sector within the controlled airspace. One or more waypoints 106-1, 106-2, 106-3 may be added to the flight route 100 to further define the horizontal routing of the route. Horizontal within the scope of the application is defined within the plane of latitude and longitude—it will be appreciated that the plane of latitude and longitude is still considered to be "horizontal" even when taking into account the curvature of the earth. Waypoints 106-1, 106-2, 106-3 may be defined by airways, named points or navigation beacons. Waypoints 106-1, 106-2, 106-3 may also be points at a prescribed latitude and longitude. Although FIG. 1 illustrates a flight route 100 with three waypoints 106-1, 106-2, 106-3, the number of waypoints for a given flight route 100 may be significantly more depending of the length of the flight route 100. Alternatively, the flight route 100 may contain no waypoints and only be defined a start point 102 and an end point 104.

Figure 2:
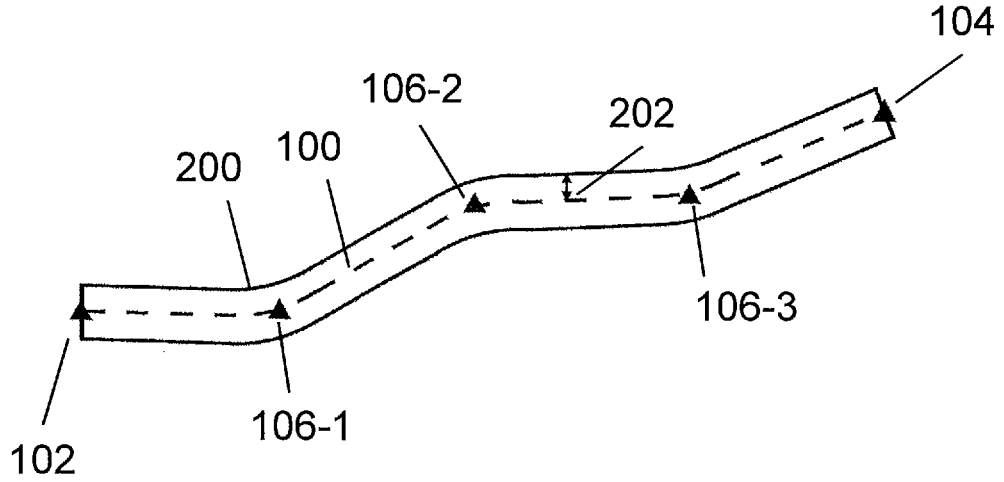
FIG. 2 is a schematic diagram of a second example of a flight route.

FIG. 2 illustrates another example of a flight route 200 (a flight route of the type shown in FIG. 2 may also be referred to as a flight path). Flight route 200 may be a series of one or more corridors in the horizontal plane around the nominal flight route 100. Flight route 200 may be a sphere-swept volume around the nominal flight route 100. Flight route 200 represents the region within which an aircraft is expected to be positioned during its flight. The width 202 of flight route 200 either side of the nominal flight route 100 may be defined by the navigation tolerances set out the operational performance specifications, such as Eurocae ED-75C/MASPS "Required Navigational Performance for Area Navigation" and equivalents thereof. The width 202 of flight route 200 may be defined by the navigational performance of the aircraft. The width 202 of flight route 200 may be defined by the navigational requirements of the route. The width 202 of flight route 200 may vary along the flight route 200.

From this point forth corridor flight paths 200 are considered and depicted. This is not intended to be in anyway limiting and other embodiments may perform conflict detection using zero-width flight routes 100.

Flight route 200 defines the horizontal routing of a flight, accounting for the latitudinal and longitudinal position of the aircraft without accounting for altitude or time. An aircraft flying along a flight route will have a predicted trajectory. A predicted trajectory is a time ordered sequence of when and where the aircraft will be during a flight. The predicted trajectory comprises the predicted horizontal position, predicted altitude and predicted timings for each position during the aircraft's flight. The predicted trajectories of pending flights, such as those for aircraft which have not taken off, cover the whole of the aircraft's flight along a flight route. The predicted horizontal positions in the predicted trajectory of a pending flight may correspond to a flight route.

Multiple aircraft may file a flight plan using the same flight route 200, for example for flights between the same origin and destination airports with different departure times or for the same flight route flown in the opposite direction. As such, the timings of the predicted trajectories for each aircraft flying a given flight route may be different. Aircraft flying the same flight route may be of a different type or configuration resulting in different cruise and climb performance. As such, the predicted altitudes and predicted timings for each aircraft flying a given flight route may be different. The predicted trajectories for each aircraft flying a given flight route 200 may therefore be different.

When the horizontal separation between two or more flight routes is below a predetermined horizontal distance then a conflict may occur between aircraft flying according to those flight routes. A conflict path can be defined as a portion of a flight route which has a horizontal separation from another flight route less than a predetermined horizontal distance.

Conflict detection may involve identifying flight routes for a plurality of aircraft. Based on the identified flight routes, conflict detection may then involve identifying one or more conflict paths, which are regions of the flight routes separated from other flight routes by less than a given horizontal distance. Conflict paths may be identified independent of the predicted trajectories of the aircraft.

Figure 3:
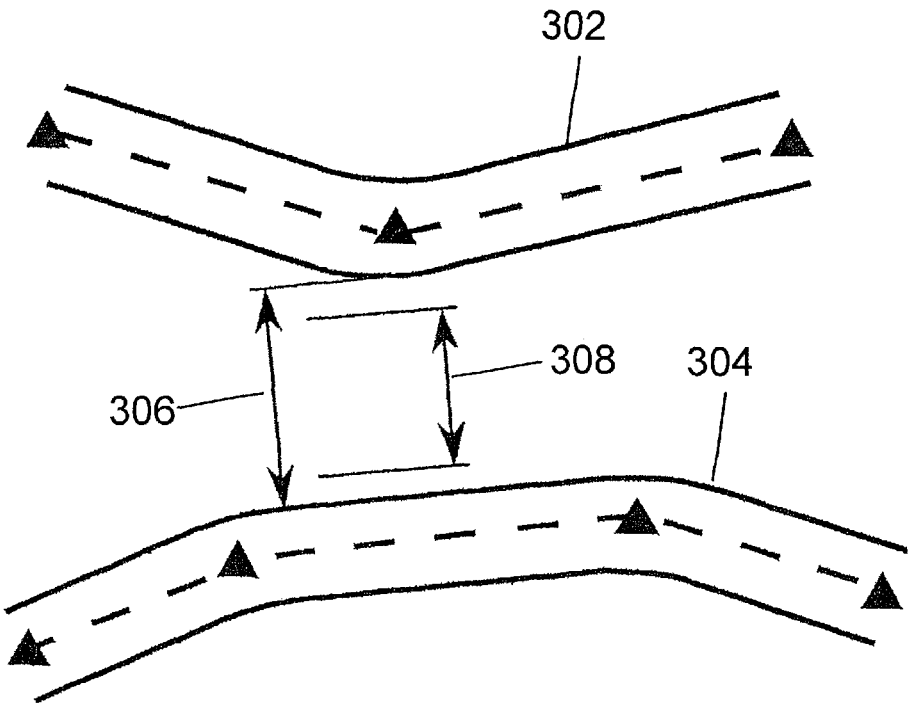
FIG. 3 is a schematic diagram of two flight routes which have a minimum horizontal separation greater than a predetermined horizontal distance.

FIG. 3 illustrates two flight routes 302, 304 which have a minimum horizontal separation 306 greater than a predetermined horizontal distance 308. The minimum horizontal distance 306 is defined as the smallest distance between the flight routes regardless of whether a zero-width flight route 100 or corridor flight route 200 is considered. The predetermined horizontal distance 308 may take into account whether a zero-width flight route 100 or corridor flight route 200 is being considered. For example, the predetermined horizontal distance between two zero-width flight routes 100 may be longer than the predetermined horizontal distance 308 between two corridor flight routes 200. The predetermined horizontal distance between two zero-width flight routes 100 may also be equal to the predetermined horizontal distance 308 between two corridor flight routes 200 plus the width 202 of each corridor flight route 200.

In this example, as the minimum horizontal separation 306 is greater than the predetermined horizontal distance 308, and so no conflict paths exist for the flight routes 302, 304. Therefore, separation of aircraft flying according to the flight routes 302, 304 can be assured, regardless of the actual timings and altitudes at which the aircraft are expected to be on the flight routes, since nowhere at any part of the flight routes would the aircraft lose horizontal separation whilst flying within their required navigational limits. Conflict path identification therefore allows separation assurance to be determined independent of the predicted trajectories of the aircraft, thus without considering altitude or flight timings of an aircraft. This allows pairs of aircraft flying along flight routes 302, 304 to be eliminated from trajectory analysis altogether, reducing the number of pairs of aircraft that need to be considered.

Figure 4:
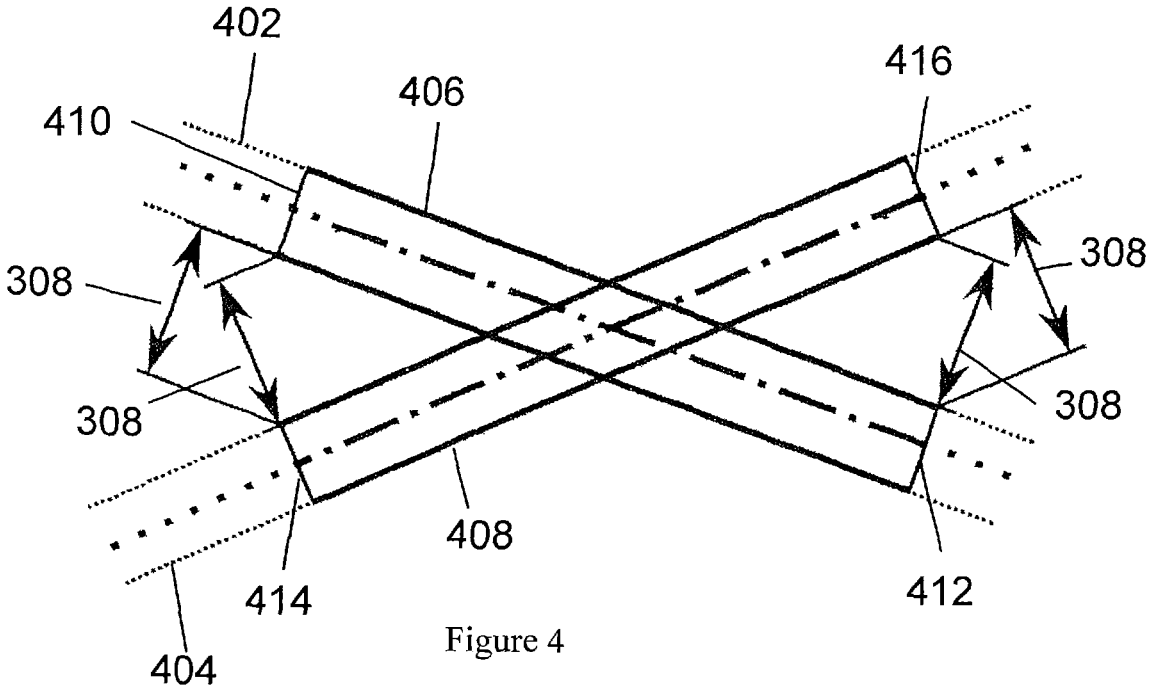
FIG. 4 is a schematic diagram of two crossing flight routes and the corresponding conflict paths.

FIG. 4 illustrates two crossing flight routes 402, 404. As the minimum horizontal distance between the two flight routes 402, 404 is less than the predetermined horizontal distance 308, a conflict path for each flight route exists. Conflict path 406 corresponds to flight route 402 and conflict path 408 corresponds to flight route 404. The first end 410 of conflict path 406 corresponds to the first point along flight route 402 where the horizontal separation is less than the predetermined horizontal distance 308. The second end 412 of conflict path 406 corresponds to the last point along the flight route 402 where the horizontal separation is less than the predetermined horizontal distance 308. Similarly, the first end 414 of conflict path 408 corresponds to the first point along flight route 404 where the horizontal separation is less than the predetermined horizontal distance 308 and the second end 416 of conflict path 408 corresponds to the last point along the flight route 404 where the horizontal separation is less than the predetermined horizontal distance 308. The conflict paths 406, 408 may just be defined by a start point 410, 414 and an end point 412, 416 without any width. Flight routes may have multiple conflict paths along their length corresponding to different conflicting flight routes.

Figure 28:
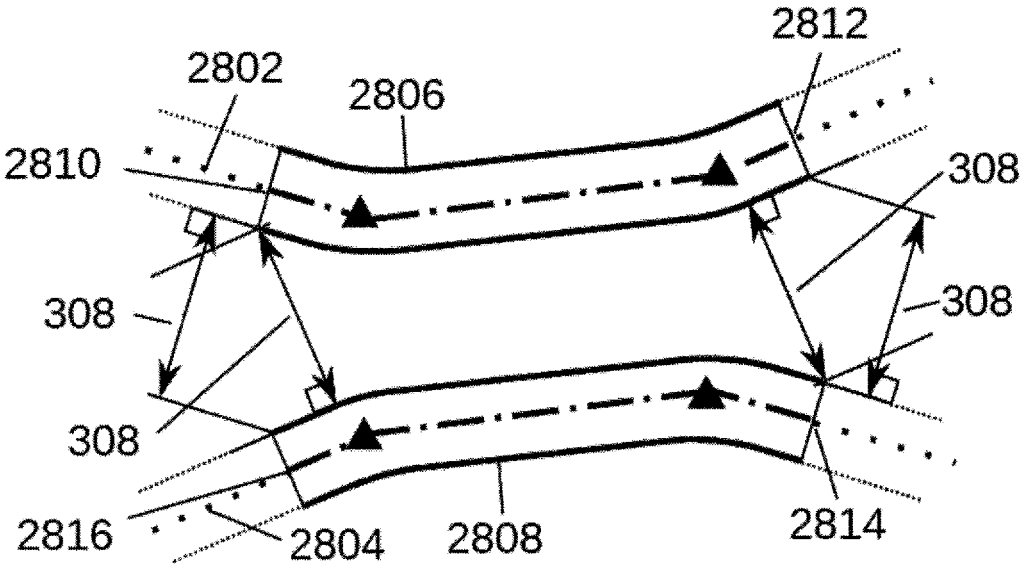
FIG. 28 is a schematic diagram of two parallel flight routes and the corresponding conflict paths.

FIG. 28 illustrates two parallel flight routes 2802, 2804. As the minimum horizontal distance between the two flight routes is less than the predetermined horizontal distance 308 a conflict path for each flight route exists, Conflict path 2806 corresponds to flight route 2802 and conflict path 2808 corresponds to flight route 2804. The first end 2810 of conflict path 2806 corresponds to the first point along flight route 2802 where the horizontal separation is less than the predetermined horizontal distance 308. The second end 2812 of conflict path 2806 corresponds to the last point along the flight route 2802 where the horizontal separation is less than the predetermined horizontal distance 308. Similarly, the first end 2814 of conflict path 2808 corresponds to the first point along flight route 2804 where the horizontal separation is less than the predetermined horizontal distance 308 and the second end 2816 of conflict path 2808 corresponds to the last point along the flight route 2804 where the horizontal separation is less than the predetermined horizontal distance 308. The conflict paths 2806, 2808 may just be defined by a start point 2810, 2814 and an end point 2812, 2816 without any width.

Figure 29:
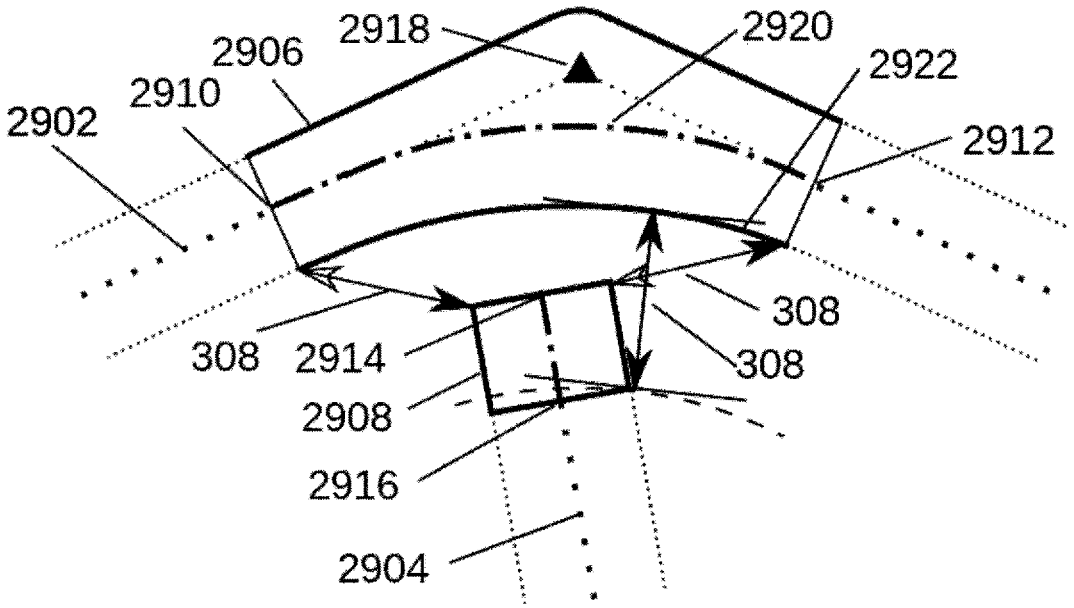
FIG. 29 is a schematic diagram of a turning flight route and a flight route inside the turn and the corresponding conflict paths.

FIG. 29 illustrates a flight route 2902 that has a fly-by turn 2920 at waypoint 2918 and a flight route 2904 that starts inside the fly-by turn of route 2902. As the minimum horizontal distance between the between the two flight routes is less than the predetermined horizontal distance 308 a conflict path for each flight route exists. Conflict path 2906 corresponds to flight route 2902 and conflict path 2908 corresponds to flight route 2904. The first end 2910 of conflict path 2906 corresponds to the first point along flight route 2902 where the horizontal separation is less than the predetermined horizontal distance 308. The second end 2912 of conflict path 2906 corresponds to the last point along the flight route 2902 where the horizontal separation is less than the predetermined horizontal distance 308. Similarly, the first end 2914 of conflict path 2908 corresponds to the first point along flight route 2904 where the horizontal separation is less than the predetermined horizontal distance 308 and the second end 2916 of conflict path 2908 corresponds to the last point along the flight route 2904 where the horizontal separation is less than the predetermined horizontal distance 308 from the fly-by turn tolerance 2922 of flight route 2902. The conflict paths 2906, 2908 may just be defined by a start point 2910, 2914 and an end point 2912, 2916 without any width.

Similarly, if in the example of FIG. 3 the minimum horizontal separation 306 had been smaller than the predetermined horizontal distance 308 then conflict paths would be identified corresponding to portions of the flight routes 302, 304 where the horizontal separation 306 is smaller than the predetermined horizontal distance 308.

Figure 5:
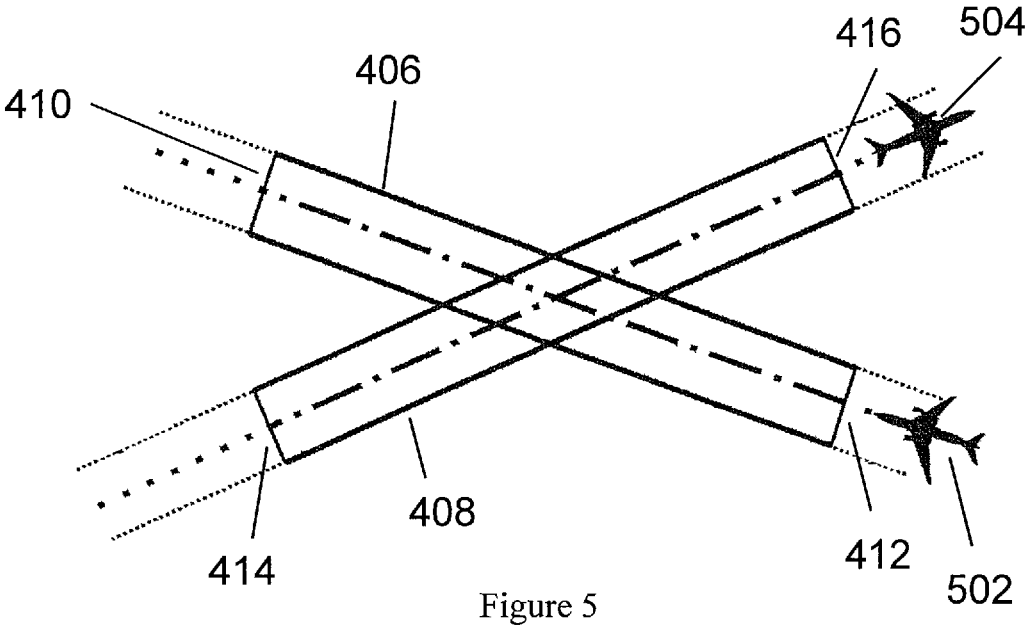
FIG. 5 is a schematic diagram of the trajectories of a hazarding pair of aircraft along a pair of flight routes and their corresponding conflict paths.

The direction an aircraft will fly along a given flight route is not important to the determination of conflict paths (the identification of the conflict paths considers only the horizontal positions of the flight routes and not the aircraft heading, predicted timings, speeds etc. of specific aircraft flying along the routes as represented by the aircraft predicted trajectories). For example, FIG. 5 shows aircraft 502 approaching conflict path 406 wherein aircraft 502 will enter conflict path 406 at second end 412 and aircraft 502 will exit conflict path 406 at first end 410. Aircraft 504 has already traveled through conflict path 408. Having entered conflict path 408 at first end 414, aircraft 504 exited conflict path 408 at end 416.

Conflict detection may be performed using portions of the predicted trajectories of a plurality of aircraft corresponding to positions within one or more conflict paths. Portions of the predicted trajectories corresponding to positions outside conflict paths can be determined as satisfying the separation requirement (their separation can be assured) and therefore may be eliminated from subsequent conflict detection.

For a given pair of aircraft, if their corresponding flight routes have conflict paths separated by a horizontal separation less than the predetermined horizontal distance, then they are referred to as a hazarding pair of aircraft. Their corresponding conflict paths are referred to as hazarding conflict paths. Conflict detection may involve identifying at least one hazarding pair of aircraft for which the flight routes for that hazarding pair of aircraft have hazarding conflict paths separated by a horizontal separation less than a predetermined horizontal distance.

For a given hazarding pair of aircraft, it may be determined that a separation requirement is satisfied between the aircraft once one of the hazarding pair of aircraft has traveled beyond a corresponding one of the hazarding conflict paths. As illustrated in FIG. 5, hazarding pair of aircraft 502, 504 have corresponding conflict paths 406, 408. Aircraft 504 has already traveled beyond its corresponding conflict path 408, therefore it can be determined that a separation requirement is satisfied between hazarding pair of aircraft 502, 504. If it has been determined that a separation requirement is satisfied between the aircraft 502, 504 due to one of the hazarding pair of aircraft 504 having traveled beyond a corresponding hazarding conflict path 408, the given hazarding pair of aircraft 502, 504 may be eliminated from subsequent conflict detection so it is not necessary to consider the time-dependent trajectories of the hazarding pair of aircraft 502, 504 further.

At least part of the identifying conflict paths and at least part of the conflict detection may be repeated in response to identifying a new flight (e.g. a new aircraft to be considered) or an update to a flight route for an existing aircraft. A flight route may be updated to add or remove waypoints from the routing or to alter the routing for conflict avoidance.

The predicted trajectories for each aircraft may also change during the flight. Events that cause a trajectory update may include: receipt of surveillance data, a change in aircraft flight state, a change in meteorological forecast data or receipt of a new trajectory from the aircraft. Surveillance data may be received from radar systems, Automatic Dependent Surveillance-Broadcast (ADS-B) systems or other surveillance systems. An aircraft state may change at different portions of a flight, for example a flight being given pushback or taxi clearance at an airport, a flight taking off from an airport or a signal from an external Flight Information Region (FIR) that a flight is approaching an FIR boundary. Meteorological forecast data, such as wind and temperature, is updated periodically, for example every 6 hours. An aircraft may create its own predicted trajectory and send it to the ATC system for incorporation into the conflict detection method. Hence, at least part of the conflict detection may be repeated in response to an update to the predicted trajectory of an aircraft.

For a hazarding pair of aircraft for which neither aircraft has yet flown past its corresponding hazarding conflict path, the conflict detection may consider one or both of the predicted altitudes (vertical positions) and timings at which the aircraft are expected to occupy the conflict paths. A conflict is determined when there is simultaneous loss of horizontal separation, vertical separation and time separation. The identification of the hazarding conflict paths indicates a potential loss of horizontal separation. Hence, by performing checks to determine whether there is loss of time separation and/or vertical separation when the aircraft are within the conflict paths, the risk of conflict can be identified.

Figure 15:
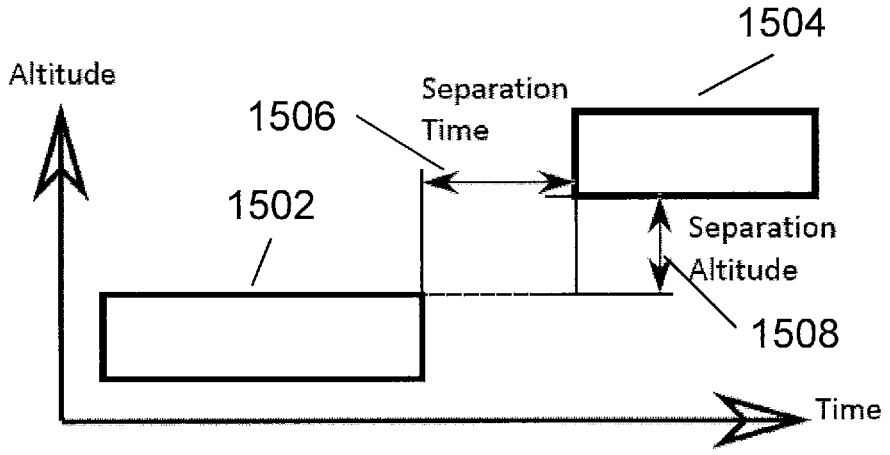
FIG. 15 is a schematic diagram indicating the time and vertical separation for a pair of hazarding aircraft.

FIG. 15 illustrates the time and altitude separation for a hazarding pair of aircraft 1502, 1504. Overall separation of a hazarding pair of aircraft 1502, 1504 may be assured if the hazarding pair of aircraft 1502, 1504 are not predicted to occupy their corresponding conflict paths at the same time or if the hazarding pair of aircraft are vertically separated at positions corresponding to their hazarding conflict paths. For example, if the separation time 1506 between the time windows when the respective aircraft are expected to be within their conflict paths is greater than a given threshold, then separation can be assured. Similarly, if the separation altitude 1508 between the altitude ranges at which the aircraft are expected to reside within the conflict paths is greater than a given threshold, then separation can be assured. To lose overall separation, the separation time 1506 of a hazarding pair of aircraft 1502, 1504 must be less than the first predetermined time threshold and the vertical separation 1508 of the hazarding pair of aircraft 1502, 1504 must be less than the predetermined vertical distance simultaneously. Hence, if the windows within which the pair of aircraft are predicted to be within their conflict paths are separated in time and/or altitude, separation can be assured without comparing the trajectories of the aircraft in more detail.

On the other hand, if the time and altitude windows within which the hazarding pair of aircraft are expected to occupy the conflict paths are not separated in time and altitude, then further checking of the trajectories can be performed as discussed below. The checking of the time separation and the vertical separation could be performed in either order. The time separation analysis is described first below, but it will be appreciated that in other embodiments the vertical separation could be considered before the time separation. Either way, if analysis of one of the time separation or vertical separation indicates that there is no loss of separation, then it is not necessary to continue to analyse the other of the time separation or the vertical separation. In some cases, if the vertical separation determination requires a comparison of the predicted altitudes at a series of time points, it may be simpler to do the time separation determination first.

FIGS. 6 to 9 show examples of determining time separation between a hazarding pair of aircraft. The time separation may be an indication of a change in timing of one of the aircraft that would cause the hazarding pair of aircraft to lose separation (if the aircraft are currently predicted to meet the separation requirement) or regain separation (if the aircraft are currently predicted to lose separation). The time separation between a given hazarding pair of aircraft may depend on the direction the aircraft are flying relative to each other. Aircraft may be defined as flying in opposing directions when the relative angle between the relative direction of the aircraft through their conflict paths is greater than or equal to 90° and aircraft may be defined as flying in corresponding directions when the relative angle between the relative direction of the aircraft through their conflict paths is less than 90°.

Figure 6:
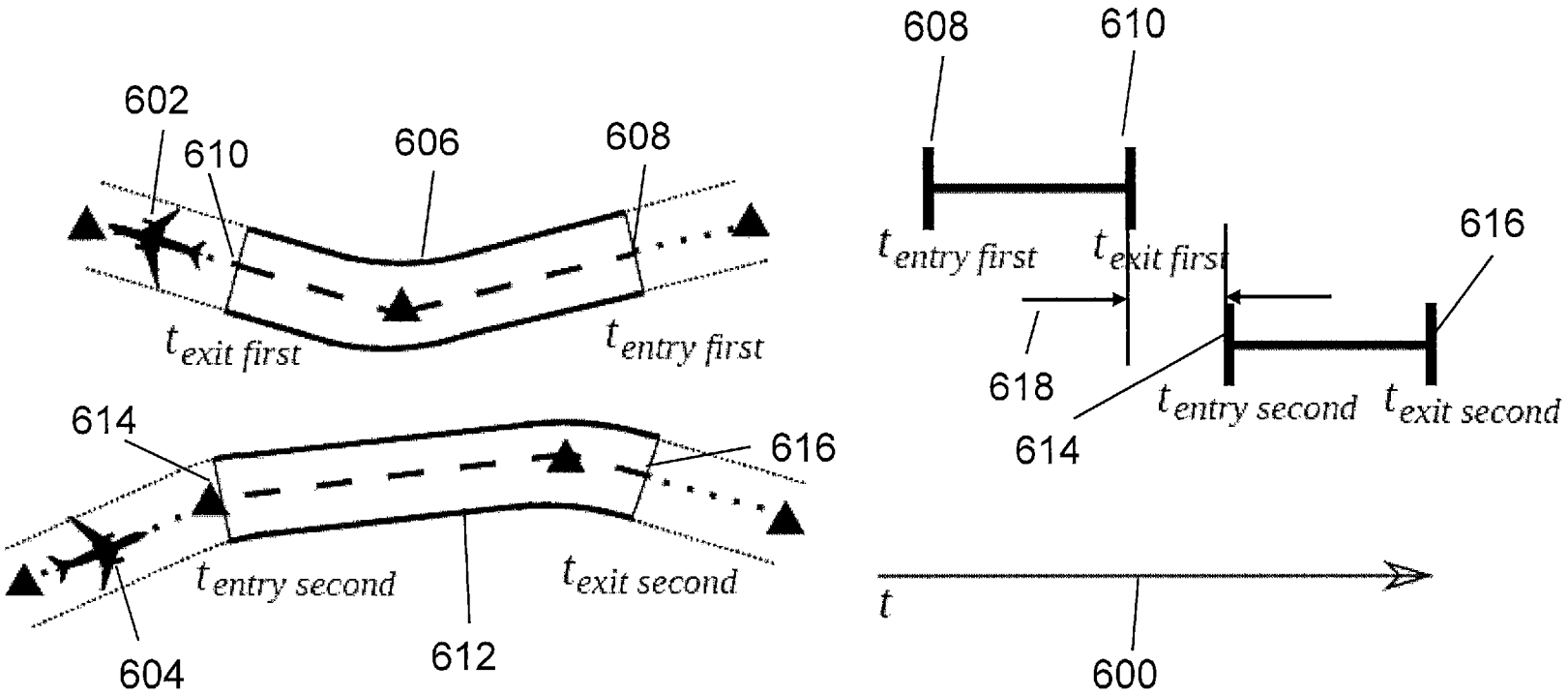
FIG. 6 is a schematic diagram of a hazarding pair of aircraft which occupy their corresponding hazarding conflict paths at different times.

FIG. 6 illustrates a hazarding pair of aircraft 602, 604 and their corresponding conflict paths 606, 612, in a case where the aircraft 602, 604 are approaching in opposing directions. The first aircraft 602 enters its corresponding conflict path 606 at time 608 and exits its corresponding conflict path 606 at time 610. The second aircraft 604 enters its corresponding conflict path 612 at time 614 and exits its corresponding conflict path 612 at time 616. The timings at which each of the hazarding pair of aircraft 602, 604 are expected to occupy their corresponding conflict paths 606, 612 can be compared to determine whether the hazarding part of aircraft 602, 604 are expected to occupy their corresponding conflict paths 606, 612 simultaneously. For example, if time 610 occurs before time 614, then the first aircraft 602 does not occupy its conflict path 606 at the same time as the second aircraft 604 occupies its conflict path 612, and it can be determined that the separation requirement is satisfied and separation is therefore assured. In the example in FIG. 6, time 610 occurs before time 614 as illustrated in time plot 600 and therefore separation of the aircraft 602, 604 can be assured as the aircraft 602, 604 cannot occupy their corresponding conflict paths 606, 612 at the same time.

A common period may be defined as the time when both aircraft in a given hazarding pair of aircraft are predicted to occupy their corresponding hazarding conflict paths simultaneously. The start of the common period may be defined as the earliest time that the second aircraft is predicted to enter its conflict path. The end of the common period the latest time that the first aircraft is predicted to exit its conflict path. The duration of the common period may then be defined as the difference between the start time and end time of the common period. If the duration is positive, this indicates the length of the period that both aircraft in a given hazarding pair of aircraft are predicted to occupy their corresponding hazarding conflict paths simultaneously (see common period 718 in FIG. 7). If the duration is negative, this indicates the amount of separation between the timings at which the aircraft occupy their conflict paths (see common period 618 in FIG. 6). In both cases, the time separation may be determined as the negation of the common period duration.

Figure 8:
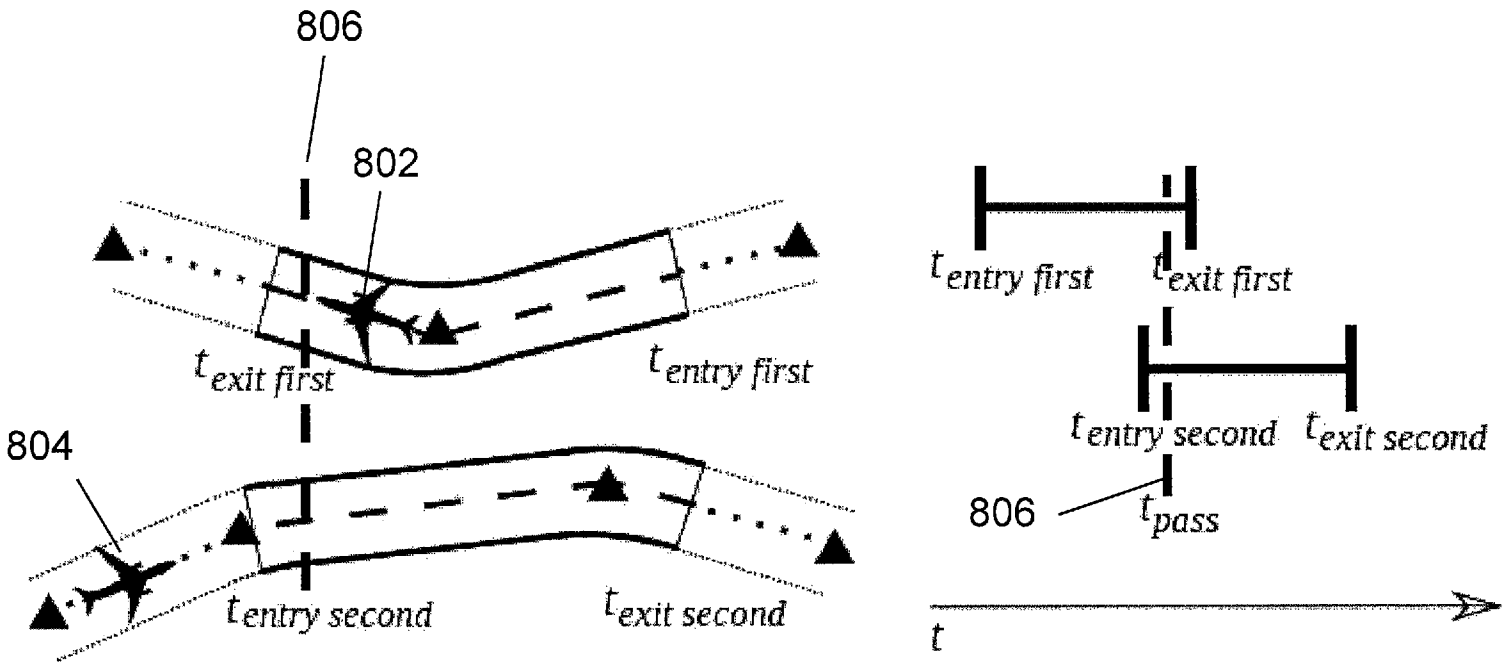
FIG. 8 is a schematic diagram of determining time separation for a hazarding pair of aircraft flying in opposing directions along their corresponding hazarding conflict paths.

The along track separation of a hazarding pair of aircraft 802, 804 will be at a minimum at the time 806 when aircraft 802 and aircraft 804 pass each other (see FIG. 8). The time 806 when aircraft 802 and aircraft 804 are predicted to pass can also be determined using the conflict paths. Also, the times when the aircraft 802, 804 are predicted to lose and regain separation can be determined, which may depend upon the time 806 when aircraft 802, 804 are predicted to pass each other and the time taken for the aircraft 802, 804 to cover the along track separation distance (i.e. the time is dependent on the relative speed of aircraft 802, 804). Examples of determining these timings are given below.

Figure 9:
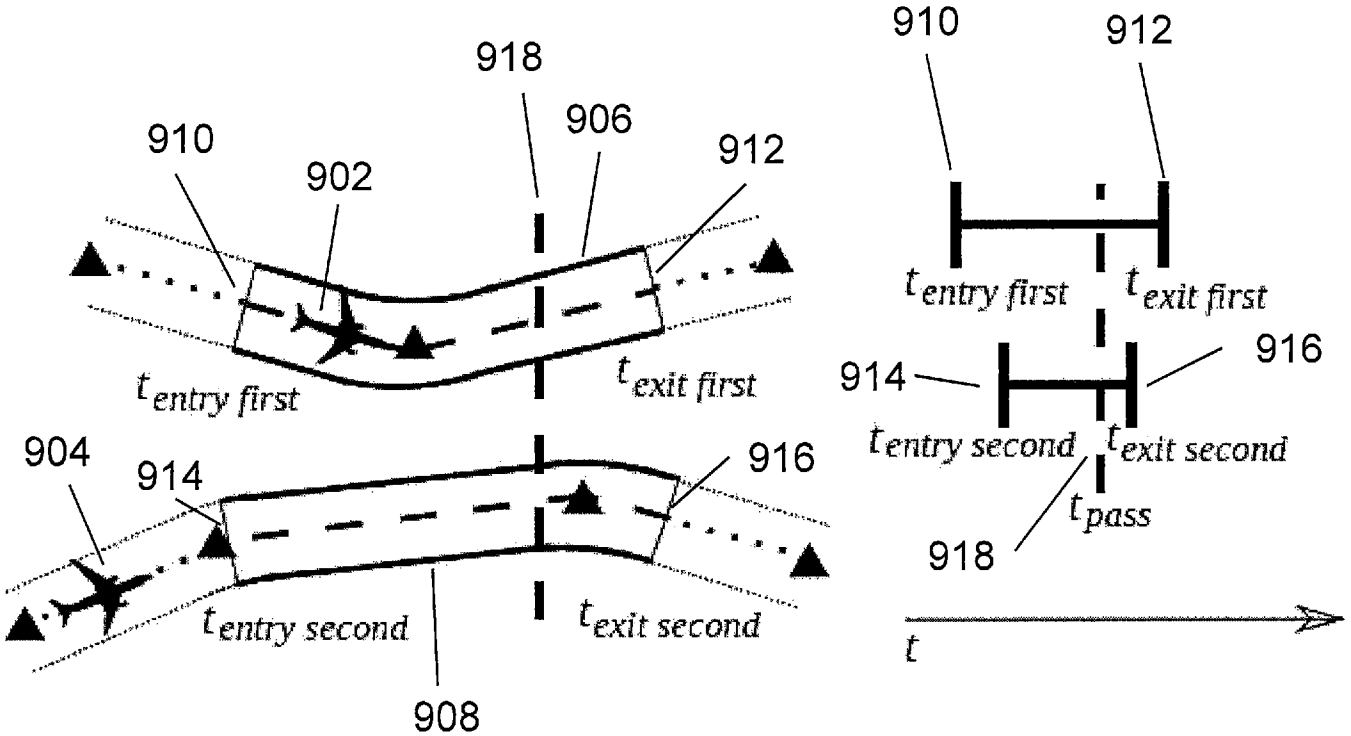
FIG. 9 is a schematic diagram of determining time separation for a hazarding pair of aircraft flying in corresponding directions along their corresponding conflict paths, where the slower aircraft enters the corresponding conflict path before the faster aircraft.

In the example illustrated in FIG. 9, aircraft 902 and aircraft 904 are flying in corresponding directions (in-trail). In this example, determining whether aircraft 902, 904 may lose separation depends upon the relative speed of aircraft 902, 904. If the first aircraft 902 to enter its corresponding conflict path 906 is flying faster than, or at the same speed as, the trailing aircraft 904 then the separation of aircraft 902, 904 can be assured if they are separated when they enter their corresponding conflict paths 906, 908. In this case, the time separation of aircraft 902, 904 may be determined based on the difference in the times that the aircraft 902, 904 are predicted to enter their corresponding conflict paths 906, 908. If the first aircraft 902 to enter its corresponding conflict path 906 is flying slower than the trailing aircraft 904 and the first aircraft 902 is predicted to exit its corresponding conflict path 906 before the trailing aircraft 904 is predicted to exit its corresponding conflict path 908 then the time separation may be determined based on the difference in the times that the aircraft 902, 904 are predicted to exit their corresponding conflict paths 906, 908. Examples of these calculations are given below.

In the example illustrated in FIG. 9, aircraft 904 is predicted to enter 914 its corresponding conflict path 908 after aircraft 902 is predicted to enter 910 its corresponding conflict path 906 and aircraft 904 is predicted to exit 916 its corresponding conflict path 908 before aircraft 902 is predicted to exit 912 its corresponding conflict path 906. As such, aircraft 904 will pass 918 aircraft 902 whilst both aircraft are in their corresponding conflict paths. In this example, the time separation may be the smaller of time separations determined by the entry 910, 914 and exit 912, 916 times of the aircraft.

For aircraft flying in-trail, the times when the aircraft 902, 904 are predicted to lose and regain separation may depend on the relative speed of the aircraft 902, 904 and their separation distance when the aircraft 902, 904 enter their corresponding conflict paths 906, 908.

To lose horizontal separation, a hazarding pair of aircraft must lose both along-track and across-track separation simultaneously. For example, the hazarding pair of aircraft must lose along-track separation during the common period whilst both aircraft in the hazarding pair of aircraft are flying through their corresponding conflict paths.

It may be determined that the separation requirement is satisfied between a given hazarding pair of aircraft when the time separation is greater than a first predetermined time threshold. If it has been determined that the separation requirement is satisfied between a hazarding pair of aircraft due to the time separation being greater than a first predetermined time threshold, the given hazarding pair of aircraft may be eliminated from subsequent conflict detection. The first predetermined time threshold may be zero. The first predetermined time threshold may be greater than zero, for example 1 minute or longer, to account for uncertainty in the predicted timings of the aircraft.

A time period during which separation cannot be assured may be determined at the timings between the first time that the horizontal separation between the predicted trajectories of a hazarding pair of aircraft is less than the predetermined horizontal distance and the last time that the horizontal separation between the predicted trajectories of a hazarding pair of aircraft is less than the predetermined horizontal distance. This time period may also be used to determine the earliest time that separation between a hazarding pair of aircraft may be lost or no longer assured.

Figure 10:
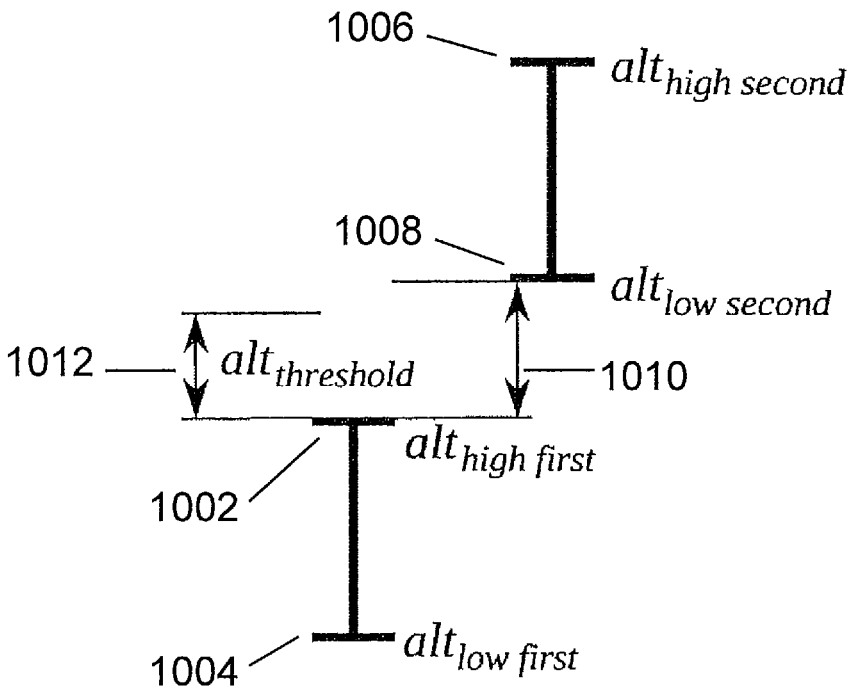
FIG. 10 is a schematic diagram of determining vertical separation for an example hazarding pair of aircraft for which the separation requirement is satisfied.
Figure 11:
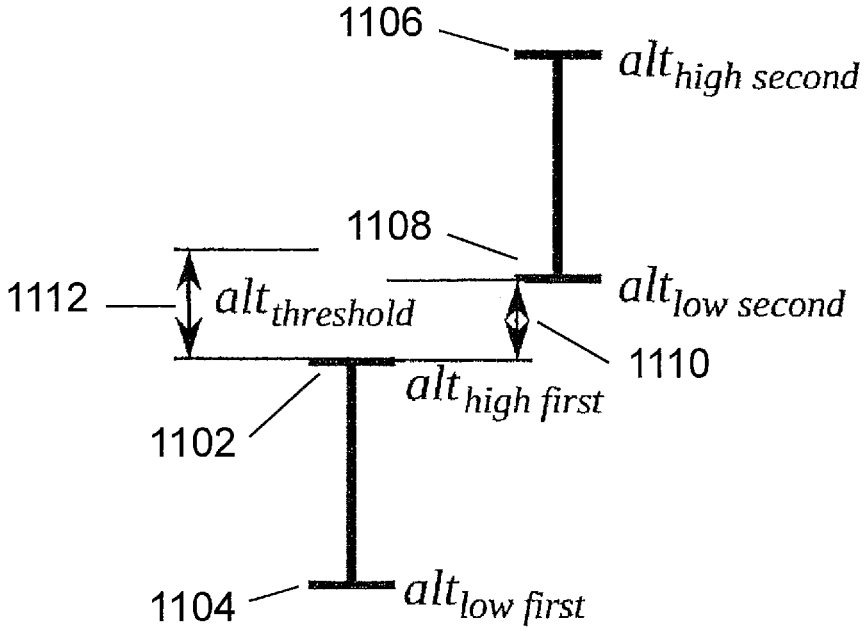
FIG. 11 is a schematic diagram of determining vertical separation for an example hazarding pair of aircraft for which there is loss of vertical separation.

FIGS. 10 and 11 show examples of determining whether there is loss of vertical separation. The vertical separation of a hazarding pair of aircraft may be determined based on the predicted altitude of each aircraft in the hazarding pair of aircraft at positions corresponding to their respective hazarding conflict paths. The predicted altitude of each aircraft may represent a prescribed clearance level that the aircraft has been requested to maintain or be based on the altitudes defined in the trajectory for the aircraft.

The vertical separation of the hazarding pair of aircraft may be determined based on a range of altitudes that each aircraft in the hazarding pair of aircraft can occupy whilst positioned inside their respective hazarding conflict paths.

FIG. 10 illustrates the ranges of altitudes for each aircraft in an example hazarding pair of aircraft whilst positioned inside their respective hazarding conflict paths. The first aircraft has a maximum altitude 1002 and minimum altitude 1004 whilst positioned inside its conflict path and the second aircraft has a maximum altitude 1006 and a minimum altitude 1008 whilst inside its conflict path. The vertical separation between the hazarding pair of aircraft may be determined based upon the altitudes that the hazarding pair of aircraft occupy at the same time whilst both aircraft are situated within their respective hazarding conflict paths.

It may be determined that the separation requirement is satisfied and that separation is assured between a given hazarding pair of aircraft when the vertical separation is greater than a predetermined vertical distance at each time that both aircraft in the hazarding pair of aircraft occupy their respective conflict paths. If it has been determined that the separation is assured between a hazarding pair of aircraft due to the vertical separation being greater than a predetermined vertical distance, the given hazarding pair of aircraft may be eliminated from subsequent conflict detection. For example the predetermined vertical distance may be 1000 feet. The predetermined vertical distance may be greater than 1000 feet, for example 2000 feet or more, to account for uncertainty in the predicted altitudes of the aircraft.

In the example illustrated in FIG. 10, the vertical separation 1010 between the predicted altitudes of the first aircraft and the second aircraft at each time that both aircraft in the hazarding pair of aircraft occupy their respective conflict paths is greater than the predetermined vertical distance 1012 and therefore it may be determined that separation is assured between the two aircraft. FIG. 11 illustrates a different example of the ranges of altitudes for each aircraft in an example hazarding pair of aircraft whilst positioned inside their respective hazarding conflict paths. The vertical separation 1110 between the first aircraft and the second aircraft at a given time is less than the predetermined vertical distance 1112 and therefore separation between the two aircraft cannot be assured.

The vertical separation of a hazarding pair of aircraft may be determined for any flight phase of an aircraft which has a position corresponding to the hazarding conflict paths. For example, one aircraft in the hazarding pair of aircraft may be in level flight whilst the other is descending, both aircraft in the hazarding pair of aircraft may be climbing or one aircraft in the hazarding pair of aircraft may be descending whilst the other is climbing and other combinations thereof. The vertical separation of a hazarding pair of aircraft may be determined in the same way regardless of the direction of travel of each aircraft in the hazarding aircraft pair.

For a hazarding pair of aircraft which are in level flight or where both aircraft are climbing and descending simultaneously, if the vertical separation when the aircraft enter their corresponding hazarding conflict paths is greater than the predetermined vertical distance, vertical separation may be assured if the vertical separation between each point in time along their predicted trajectories corresponding to a hazarding conflict path is greater than the predetermined vertical distance.

Figure 12:
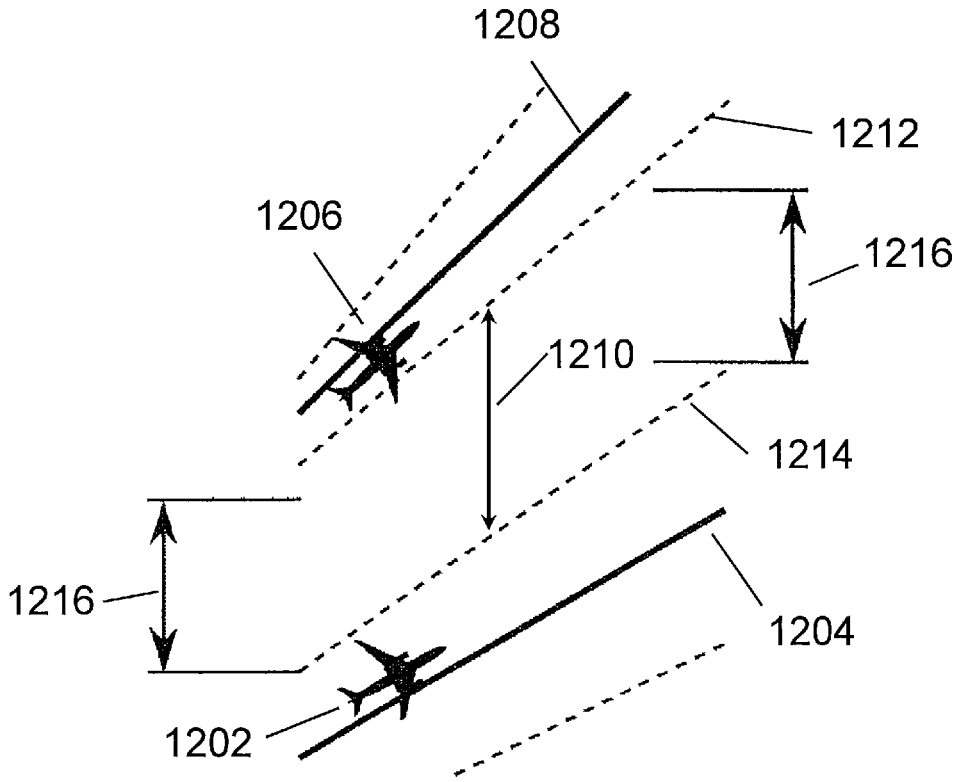
FIG. 12 is a schematic diagram of a first aircraft climbing along a predicted trajectory and a second aircraft climbing along a different predicted trajectory.

FIG. 12 illustrates an example where a first aircraft 1202 is climbing along a predicted trajectory 1204 and a second aircraft 1206 is climbing along a predicted trajectory 1208. Aircraft 1206 is above aircraft 1202 and the separation 1210 between the higher aircraft 1206 and the lower aircraft 1202 is initially greater than the predetermined vertical distance 1216. The separation 1210 between the lowest predicted trajectory 1212 of the higher aircraft 1206 and the highest predicted trajectory 1214 of the lower aircraft 1202 is greater than the predetermined vertical distance 1216 at each point along the predicted trajectories of the aircraft. As such, it may be determined that vertical separation is assured between the two aircraft and separation may be assured.

Figure 13:
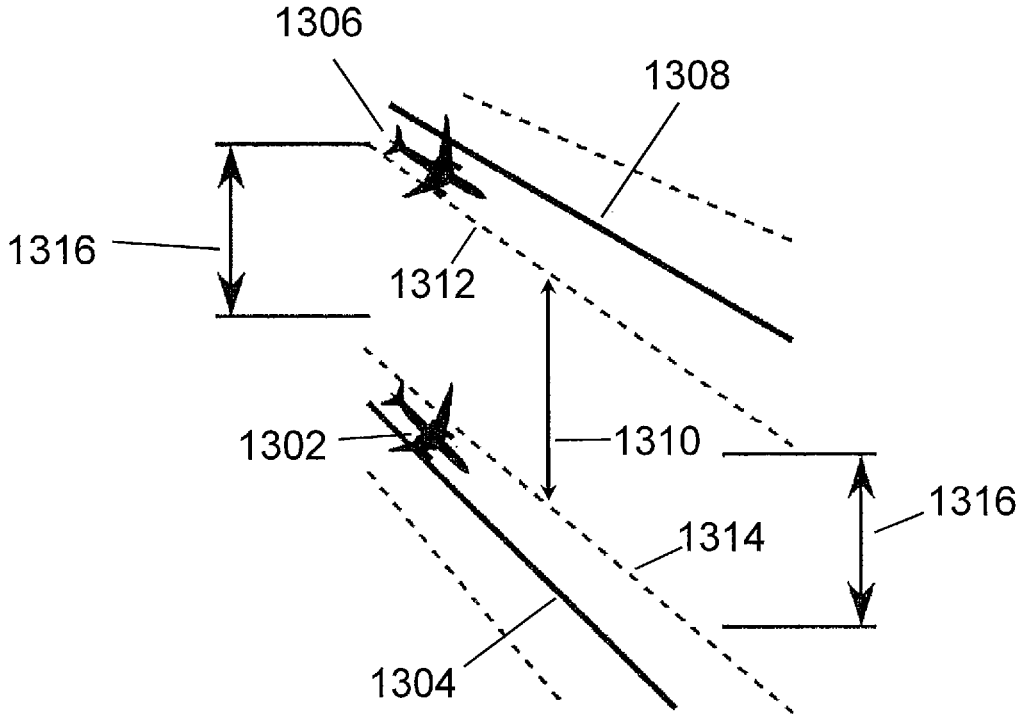
FIG. 13 is a schematic diagram of a first aircraft descending along a predicted trajectory and a second aircraft descending along a different predicted trajectory.

FIG. 13 illustrates an example where a first aircraft 1302 is descending along a predicted trajectory 1304 and a second aircraft 1306 is descending along a predicted trajectory 1308. Aircraft 1306 is above aircraft 1302 and the separation 1310 between the higher aircraft 1306 and the lower aircraft 1302 is initially greater than the predetermined vertical distance 1316. The separation 1310 between the lowest predicted trajectory 1312 of the higher aircraft 1306 and the highest predicted trajectory 1314 of the lower aircraft 1302 is greater than the predetermined vertical distance 1316 at each point along the predicted trajectories of the aircraft. As such, it may be determined that vertical separation is assured between the two aircraft and separation may be assured.

Figure 14:
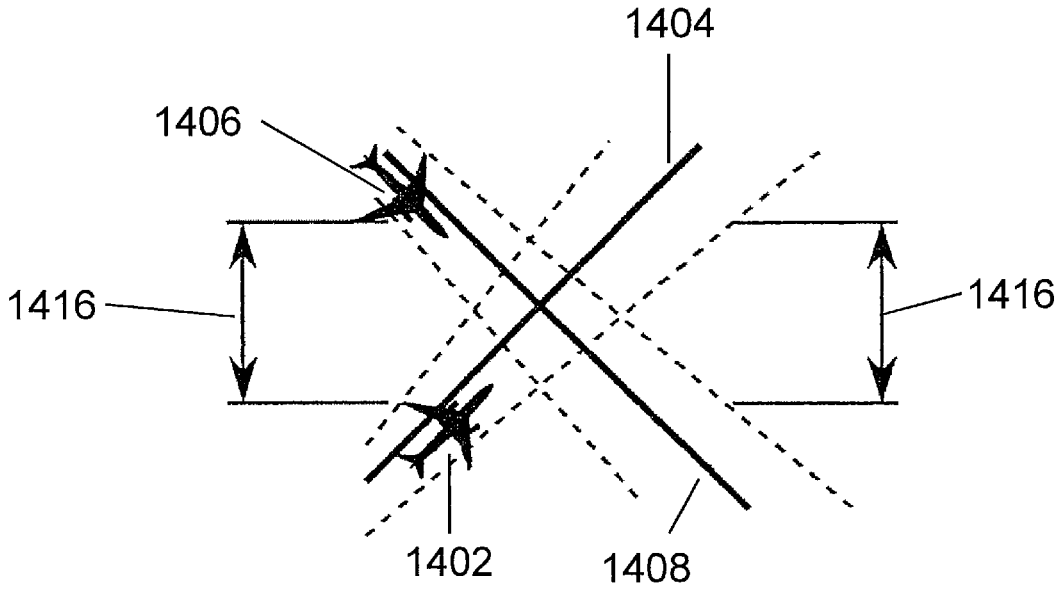
FIG. 14 is a schematic diagram of a first aircraft climbing along a predicted trajectory and a second aircraft descending along a different predicted trajectory.

FIG. 14 illustrates an example where a first aircraft 1402 is climbing along a predicted trajectory 1404 and a second aircraft 1406 is descending along a predicted trajectory 1408. The vertical separation at positions along the predicted trajectories 1404, 1408 of the aircraft 1402, 1406 fall below the predetermined vertical distance 1416. As such, separation between the two aircraft cannot be assured. A period during which separation cannot be assured may be determined at the timings between the first time that the vertical separation between the predicted altitudes of a hazarding pair of aircraft is less than the predetermined vertical distance 1416 and the last time that the vertical separation between the predicted altitudes of a hazarding pair of aircraft is less than the predetermined vertical distance 1416.

A warning indication may be outputted if for a given hazarding pair of aircraft when the time separation is less than a second predetermined time threshold. The warning may be audible or visual, or a combination thereof. For example a symbol may be displayed or flashed on a display screen, accompanied by an audible alarm sounding. The second predetermined time threshold may be less than the first predetermined time threshold, for example the second predetermined time threshold could be zero and the first predetermined time threshold could be 1 minute. Alternatively, the first and second predetermined time thresholds could be the same.

An indication of the time separation determined for at least one hazarding pair of aircraft may be displayed. The indication may be text, a picture or combinations thereof.

A graphical representation of the time separation for one or more hazarding pairs of aircraft may be displayed. For example a symbol representing the hazarding pair of aircraft may be displayed on a display screen. The symbol representing the hazarding pair of aircraft may also contain additional information about the hazarding pair of aircraft, for example the callsigns of each aircraft in the hazarding pair of aircraft. The symbol representing the hazarding pair of aircraft may also give an indication of the direction the aircraft in the hazarding pair of aircraft are flying relative to each other. For example, a first symbol may be used if the aircraft are travelling in opposing directions and a second symbol may be used if the aircraft are travelling in corresponding directions. The symbol may also give an indication of which aircraft in the hazarding pair of aircraft is travelling faster, or which aircraft in the hazarding pair of aircraft is predicted to enter a hazarding conflict path first. For example, a third symbol may be used to indicate an aircraft that is travelling faster, or the callsigns for the hazarding pair of aircraft may be listed in order of aircraft speed. Alternatively, the callsigns for the hazarding pair of aircraft may be listed in order of the position of the aircraft, for example the callsign for the aircraft predicted to enter a hazarding conflict path first, or the lead aircraft, may be displayed above or to the left of the callsign for the trailing aircraft. The callsign of the faster aircraft or the aircraft predicted to enter a conflict path first may also be displayed differently to the callsign of the slower aircraft or trailing aircraft, for example in a different font, style or colour.

Figure 16:
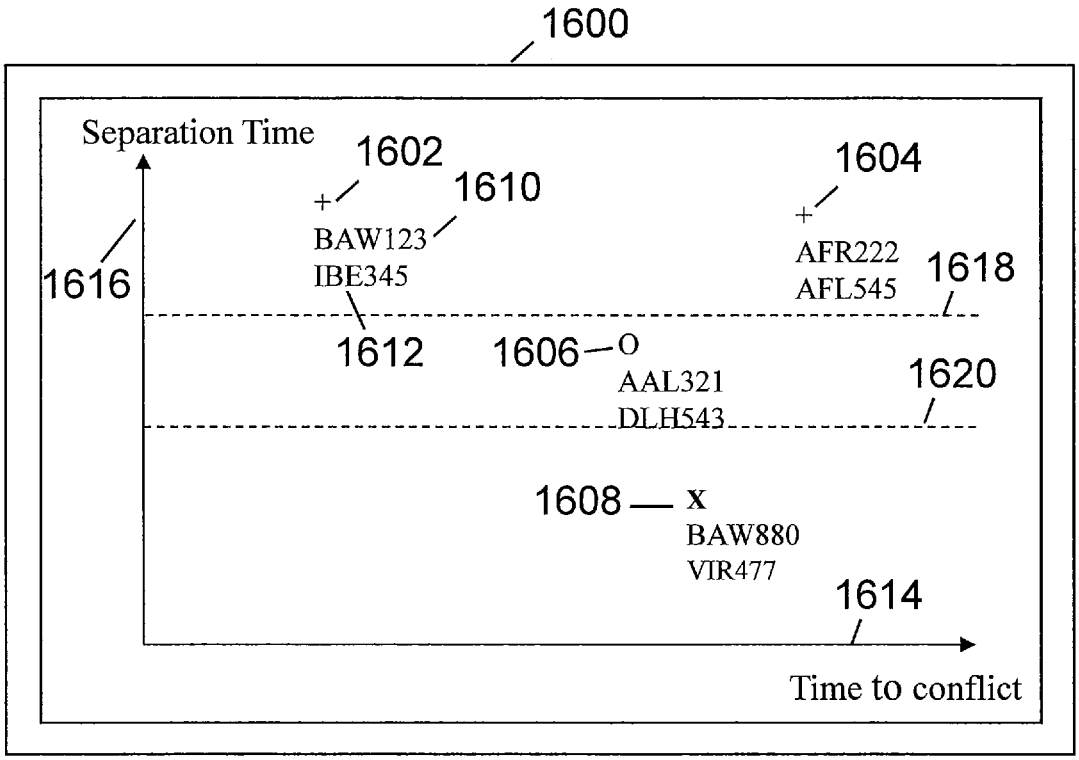
FIG. 16 is a schematic diagram of a graphical representation of the time separation for a plurality of aircraft pairs.

The graphical representation of the time separation may comprise a graph in which one or more points representing at least one hazarding pair of aircraft are plotted. FIG. 16 illustrates an example of a graphical representation 1600 of the time separation for a plurality of aircraft pairs. Each symbol 1602, 1604, 1606, 1608 represents a pair of hazarding aircraft. The callsigns 1610, 1612 of each aircraft in the hazarding pair of aircraft are displayed next to the corresponding symbol 1602. The top callsign 1610 may represent the lead aircraft or the aircraft which is travelling faster.

The x axis 1614 represents the time to conflict for a given pair of aircraft. The time to conflict may be in minutes or hours and gives an indication of the time remaining until a given pair of aircraft reach their minimum time separation. For example, the x axis 1614 may represent an expected timing at which one or the hazarding pair of aircraft is expected to be at a corresponding one of the hazarding conflict paths. The time at which a given pair of aircraft conflict may be represented by the y axis intercept or by another point on the x axis 1614. The y axis 1616 represents the time separation for each of the hazarding pair of aircraft. A time separation of zero may be represented by the x axis intercept or by another point on they axis 1616. An alternative set of axes may be used to provide a graphical representation of the time separation. Additionally, the time separation may be represented on the x axis 1614.

The first horizontal line 1618 represents the first predetermined time threshold. Symbols 1602, 1604 located above the first horizontal line 1618 represent a hazarding pair of aircraft which have a time separation greater than the first predetermined time threshold. Symbols 1606, 1608 located below the first horizontal line 1618 represent a hazarding pair of aircraft which have a time separation less than the first predetermined time threshold. The symbols 1602, 1604 located above the first horizontal line 1618 may be a different type, size and colour to the symbols 1606, 1608 located below the first horizontal line 1618.

The second horizontal line 1620 represents the second predetermined time threshold. Symbols 1608 located below the second horizontal line 1620 represent a hazarding pair of aircraft which have a time separation less than the second predetermined time threshold, i.e. pairs of aircraft for which the warning of loss of separation may be issued (if vertical separation is also not assured). Symbols 1608 located below the second horizontal line 1620 may be a different type, size and colour to the other symbols 1602, 1604, 1606. In addition, symbols 1608 located below the second horizontal line 1620 may flash on the screen, change colour periodically, have an audible tone associated with them or other means to make the symbols 1608 more prominent than other symbols located on the graph. Symbols 1606 located between the first horizontal line 1618 and the second horizontal line 1620 represent a hazarding pair of aircraft which have a time separation greater than the second predetermined time threshold but less than the first predetermined time threshold. Symbols 1606 located between the first horizontal line 1618 and the second horizontal line 1620 may be a different type, size and colour to the symbols located above the first horizontal line or below the second horizontal line.

Figure 17:
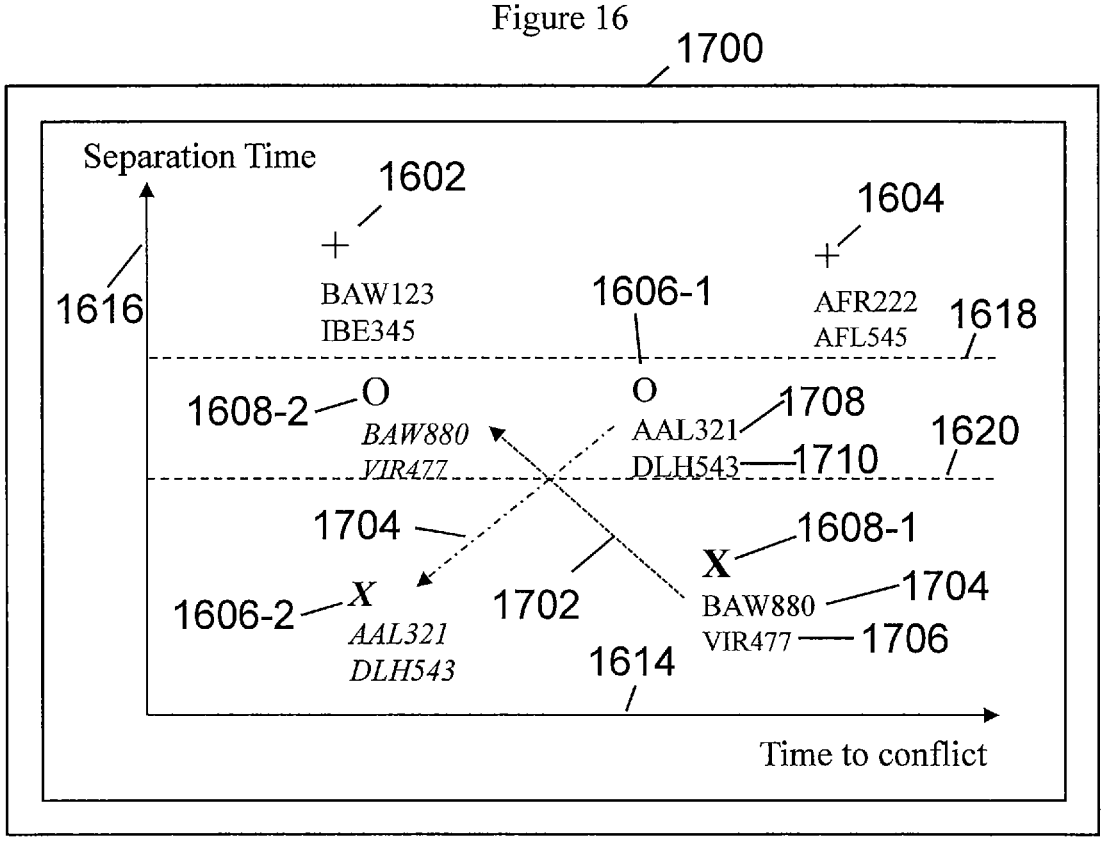
FIG. 17 is a schematic diagram of updating the graphical representation of the time separation to reflect changes in time separation over time.

The determination of the time separation for at least one hazarding pair of aircraft is repeated and the display is updated to reflect changes in the time separation over time. The determination of time separation is repeated each time part of the conflict detection is performed, for example in response to the identification of a new or updated flight route or an update to the predicted trajectory of an aircraft. FIG. 17 illustrates an example of a graphical representation 1700 of the time separation for a plurality of aircraft pairs. The symbols 1602, 1604 are the same as those indicated in FIG. 16.

Arrow 1702 indicates the movement of symbol 1608 over time. Symbol 1608 starts at an initial position 1608-1. As the changes in time separation over time are calculated, the time separation between the aircraft 1704, 1706 represented by symbol 1608 increases. Therefore as time passes, aircraft 1704 and 1706 get closer to their time to conflict, so the time to conflict decreases and symbol 1608 moves left along the x axis 1614. As the time separation between aircraft 1704 and 1706 increases over time, symbol 1608 moves up they axis 1616. Therefore, after a given period of time, symbol 1608 moves from its initial position 1608-1 to a second position 1608-2 as indicated by arrow 1702. As symbol 1608-2 is located above the second horizontal line 1620, but below the first horizontal line 1618, it will change type, size and/or colour accordingly as it crosses the second horizontal line 1620. The movement of the symbol 1608 representing a given pair of aircraft towards the top left of the display in a direction similar to arrow 1702 indicates that the likelihood of a conflict is reducing for this pair of aircraft.

Arrow 1704 indicates the movement of symbol 1606 over time. Symbol 1606 starts at an initial position 1606-1. As the changes in time separation over time are calculated, the time separation between the aircraft 1708, 1710 represented by symbol 1606 decreases. Therefore as time passes, aircraft 1708 and 1710 get closer to their respective hazarding conflict paths, so the time to conflict decreases and symbol 1606 moves left along the x axis 1614. As the time separation between aircraft 1708 and 1710 decreases over time, symbol 1606 moves down they axis 1616. Therefore, after a given period of time, symbol 1606 moves from its initial position 1606-1 to a second position 1606-2 as indicated by arrow 1704. As symbol 1606-2 is located below the second horizontal line 1620, it will change type, size and/or colour accordingly as it crosses the second horizontal line 1620. A warning indication may also be outputted at the moment when symbol 1606 crosses the second horizontal line 1620. The air traffic controller or operator of the method can easily track and monitor the movement of symbol 1606 along arrow 1704, allowing them to identify hazarding pairs of aircraft which may require corrective action before the symbol 1606 passes below the second horizontal line 1620. This allows the controller or operator of the method to take corrective action earlier, reducing the risk of conflict and increasing safety. The air traffic controller or operator can also track the movement of symbol 1608 along arrow 1702, allowing them to identify that the time separation between the aircraft is increasing such that the risk of conflict is reducing and allowing them to determine that no corrective action may be required at that time.

A rate of change of the time separation over time may be determined. The rate of change of time separation is a good indication of the way in which a conflict situation is changing and evolving. For example, a positive rate of change of the time separation indicates that the time separation between a hazarding pair of aircraft is increasing and therefore the risk of the hazarding pair of aircraft losing separation is reducing. Conversely, a negative rate of change of the time separation indicates that the time separation between a hazarding pair of aircraft is decreasing and therefore the risk of the hazarding pair of aircraft losing separation is increasing. The rate of change of time separation is expected to be positive for all active flights as the uncertainty over the position and timings of each aircraft is decreasing. A negative rate of change of time separation may therefore indicate an error in one or more of the predicted trajectories, for example due to poor or incorrect meteorological forecast data or aircraft performance data.

An indication of the rate of change of the time separation may be displayed. For example, a numerical indication of the rate of change of separation for a hazarding pair of aircraft may be indicated near their corresponding symbol

1602 on graphical representation 1600. The symbol 1602 may change colour to indicate a positive or a negative time separation. The symbol 1602 may also flash when the rate of change of time separation for the corresponding hazarding pair of aircraft is within a given range, for example when the rate of change of time separation is less than zero. The rate at which symbol 1602 flashes may also increase as the magnitude of the rate of change of time separation increases. This alerts the air traffic controller or operator of the method to a hazarding pair of aircraft which have a rapidly decreasing time separation and thus may require corrective action. Also, this also alerts the air traffic controller or operator of the method to a hazarding pair of aircraft which may have an error in one or more of their predicted trajectories.

Figure 18:
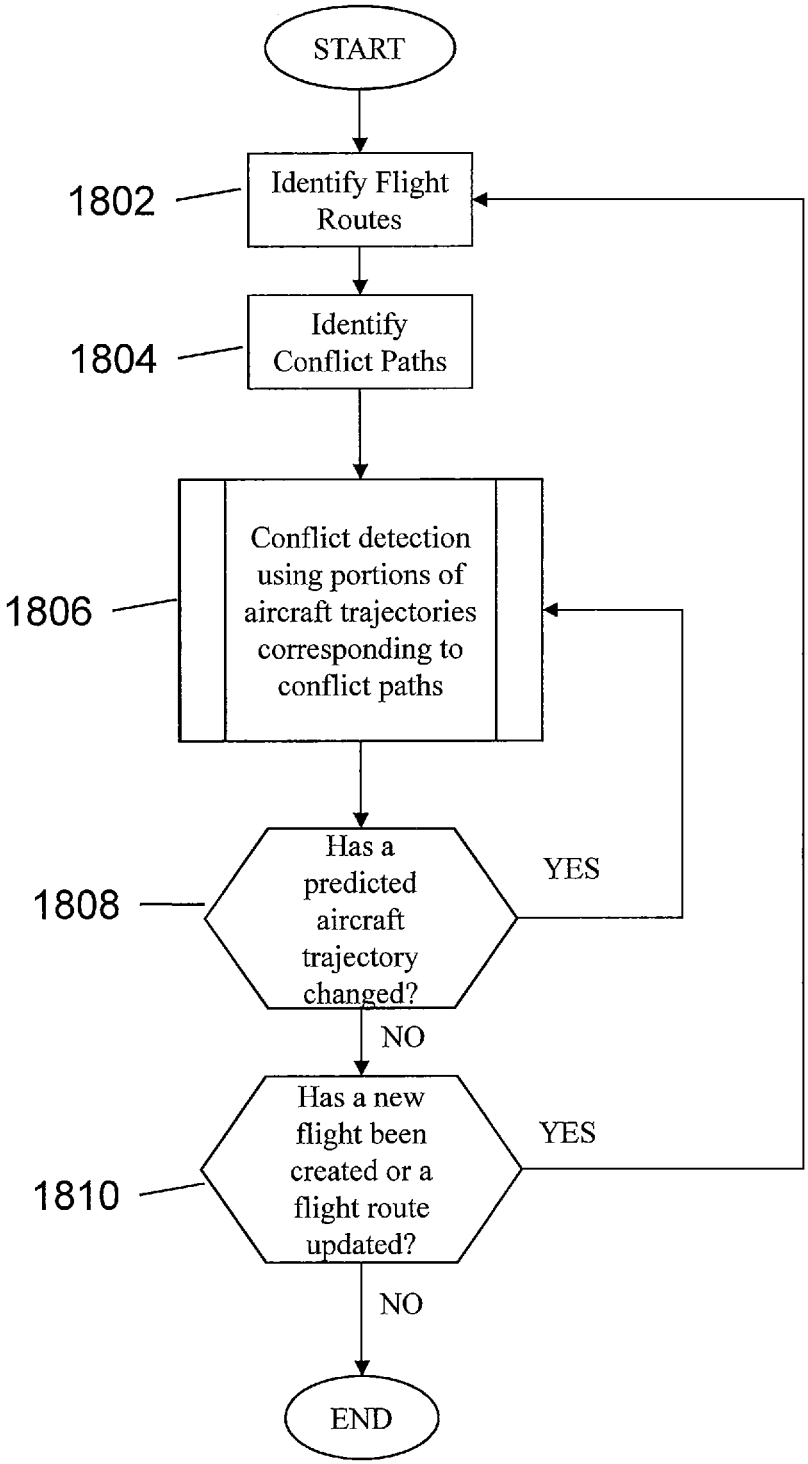
FIG. 18 is a flow diagram illustrating a method of detecting conflicts between aircraft.

FIG. 18 is a flow diagram illustrating a method of detecting conflicts between a plurality of aircraft.

At step 1802 flight routes are identified for a number of aircraft to be considered.

Figure 20:
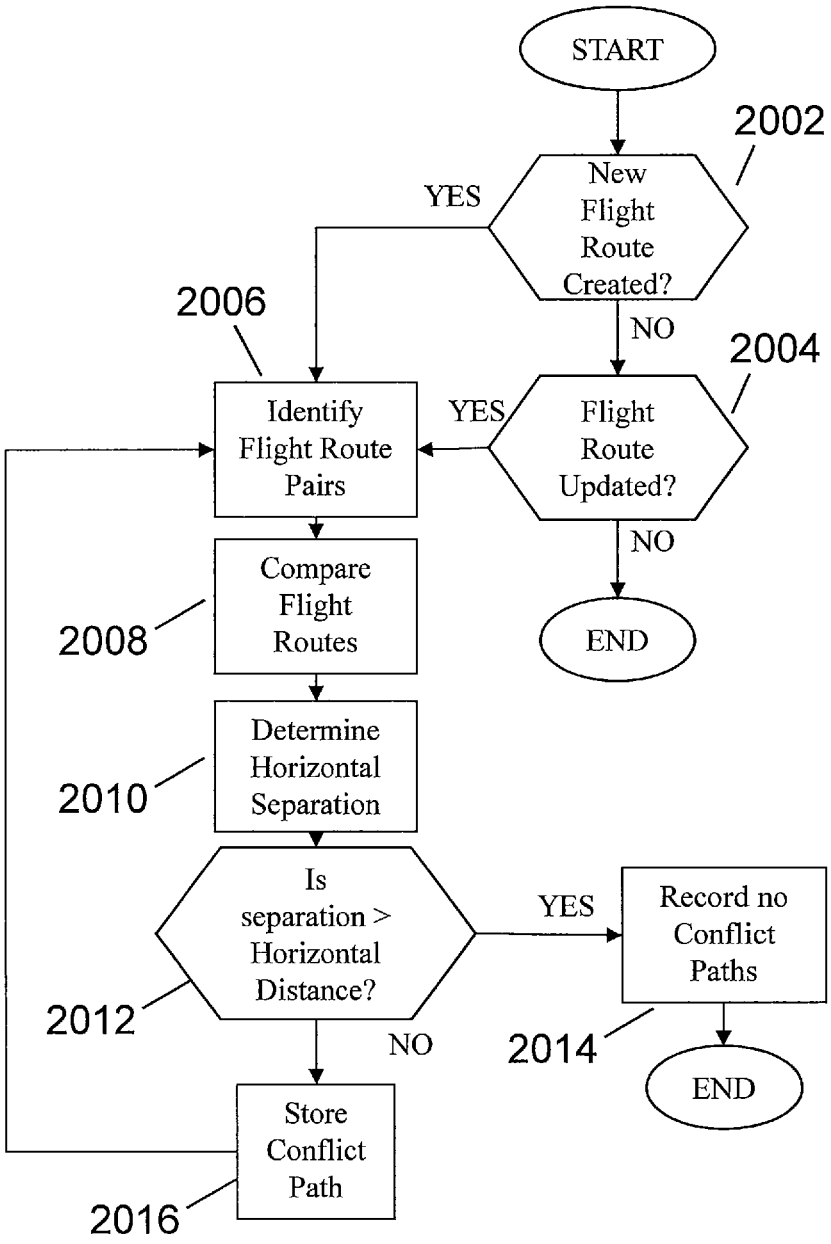
FIG. 20 is a flow diagram illustrating a method of determining conflict paths for pairs of flight routes.

At step 1804 conflict paths are identified. Conflict paths may be identified by comparing the horizontal positions of the identified flight routes to determine portions of a flight route which has a horizontal separation from another flight route less than the predetermined horizontal distance. Alternatively, conflict paths may be identified by looking up pairs of the identified flight routes in a database specifying conflict paths for each pair of flight routes (the database may be established using the method of FIG. 20 shown below).

At step 1806 conflict detection is performed using portions of aircraft trajectories corresponding to conflict paths.

At step 1808 it is determined whether a predicted aircraft trajectory has been updated. A predicted aircraft trajectory may be updated based on, for example, receipt of surveillance data, a change in aircraft flight state, a change in the meteorological forecast data or receipt of a new trajectory from the aircraft. If a predicted aircraft trajectory has been updated, the method returns to step 1806 to repeat at least part of the conflict detection (but the conflict path identification step is not repeated 1804). If a predicted aircraft trajectory has not changed, the method continues to step 1810.

At step 1810 it is determined whether a new flight has been created or a flight route has been updated. A new flight may be created when an airline wishes to fly between a new airport pair. A flight route may be updated to add or remove waypoints from the routing or to alter the routing for conflict avoidance. If a new flight has been created or a flight route has been updated, the method returns to step 1802. If no new flights have been created and no flight routes have been updated then the method ends. The method may start every time a new flight is created or a flight route is updated. The method may also be started periodically, for example every 5 seconds or every minute.

Figure 19:
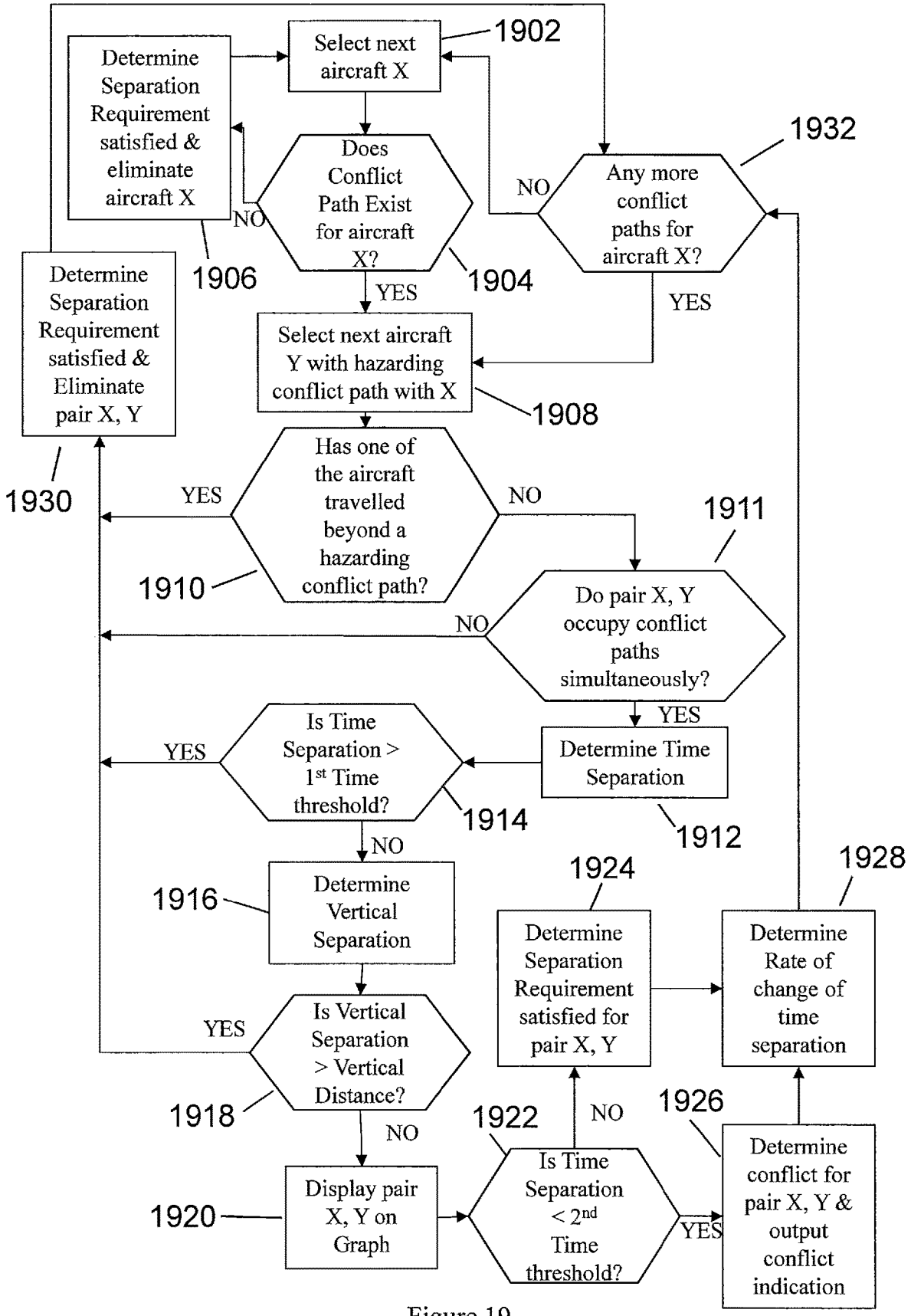
FIG. 19 is a flow diagram illustrating a method of detecting conflicts using portions of aircraft trajectories corresponding to conflict paths.

FIG. 19 is a flow diagram illustrating step 1806 in more detail. At step 1902 the next aircraft X is selected. Aircraft X has a predicted trajectory along an identified flight route.

At step 1904 it is determined whether any conflict paths exist for aircraft X. If there are no conflict paths for the flight route corresponding to the predicted trajectory of aircraft X, then the method continues to step 1906. At step 1906 it can be determined that a separation requirement is satisfied for aircraft X as there are no conflict paths corresponding to the predicted trajectory for aircraft X (i.e. no part of aircraft X's flight route is within the predetermined horizontal distance of the flight route of another aircraft being considered). Aircraft X can then be eliminated from subsequent conflict detection and the method returns to step 1902 where the next aircraft X is selected.

If, at step 1904, it is determined that conflict paths do exist for the flight route corresponding to the predicted trajectory of aircraft X then the method continues to step 1908. At step 1908 the next aircraft Y is selected. Aircraft Y is an aircraft which has a hazarding conflict path with aircraft X. Aircraft X and aircraft Y form a hazarding pair of aircraft X,Y.

At step 1910 it is determined, based on the trajectories of aircraft X, Y, whether one of aircraft X or aircraft Y has traveled beyond its hazarding conflict path. If one of aircraft X or aircraft Y has traveled beyond the hazarding conflict path then the method continues to step 1930. At step 1930 it can be determined that the separation requirement is satisfied for hazarding pair of aircraft X,Y. Hazarding pair of aircraft X,Y can then be eliminated from subsequent conflict detection and the method continues to step 1932. If, at step 1910, it is determined that neither aircraft X nor aircraft Y has traveled beyond a hazarding conflict path then the method continues to step 1911. At step 1911 it is determined, based on the trajectories of aircraft X, Y, whether the aircraft can occupy their hazarding conflict paths at the same time. If the aircraft cannot occupy the hazarding conflict paths at the same time then the method continues to step 1930. At step 1930 it can be determined that the separation requirement is satisfied for hazarding pair of aircraft X,Y. Hazarding pair of aircraft X,Y can then be eliminated from subsequent conflict detection and the method continues to step 1932. If at step 1911 it can be determined that the aircraft can occupy their hazarding conflict paths at the same time then the method continues to step 1912. At step 1912 the time separation between the timings at which the hazarding pair of aircraft X,Y are expected to be at positions corresponding to the hazarding conflict paths is determined. The time separation can be an indication of the amount of time by which the trajectory timing of one of aircraft X, Y would need to change in order to lose or regain separation.

At step 1914 it is determined whether the time separation between the timings at which the hazarding pair of aircraft X,Y are expected to be at positions corresponding to the hazarding conflict paths is greater than a first predetermined time threshold. If the time separation is greater than the first predetermined time threshold then the method continues to step 1930. At step 1930 it can be determined that the separation requirement is satisfied for hazarding pair of aircraft X,Y. Hazarding pair of aircraft X,Y can then be eliminated from subsequent conflict detection and the method continues to step 1932. If the time separation between the timings at which the hazarding pair of aircraft X,Y are expected to be at positions corresponding to the hazarding conflict paths is less than a first predetermined time threshold then the method continues to step 1916.

At step 1916 the vertical separation between the predicted trajectories of hazarding pair of aircraft X,Y at positions corresponding to the hazarding conflict paths is determined.

At step 1918 it is determined whether the minimum vertical separation between the predicted trajectories of hazarding pair of aircraft X,Y is greater than a predetermined vertical distance. If the vertical separation between the predicted trajectories of hazarding pair of aircraft X,Y is greater than a predetermined vertical distance then the method continues to step 1930. At step 1930 it can be determined that the separation requirement is satisfied for hazarding pair of aircraft X,Y. Hazarding pair of aircraft X,Y can then be eliminated from subsequent conflict detection and the method continues to step 1932. If, at step 1918, it is determined that the vertical separation between the predicted trajectories of hazarding pair of aircraft X,Y is less than a predetermined vertical distance then the method continues to step 1920. At step 1920 hazarding pair of aircraft X,Y are displayed, e.g. on a graph as shown in FIGS. 16 and 17.

At step 1922 it is determined whether the time separation between the timings at which the hazarding pair of aircraft X,Y are expected to be at positions corresponding to the hazarding conflict paths is less than a second predetermined time threshold. If the time separation is less than the second predetermined time threshold then the method continues to step 1926. At step 1926 it is determined that there is a conflict for hazarding aircraft pair X,Y and a conflict warning indication is outputted and the method continues to step 1928. If, at step 1922, the time separation is greater than the second predetermined time threshold then the method continues to step 1924. At step 1924 it is determined that the separation requirement is satisfied for hazarding pair of aircraft X,Y and the method continues to step 1928. At step 1928 the rate of change of time separation for hazarding aircraft pair X,Y is determined and the method continues to step 1932.

At step 1932 it is determined whether any more conflict paths exist for aircraft X. If additional conflict paths do exist for aircraft X then the method returns to step 1908 and the next aircraft Y is selected. If no additional conflict paths exist for aircraft X then the method returns to step 1902 and the next aircraft X is selected.

The method illustrated in FIG. 19 is applied for each aircraft X until the method has been applied to all aircraft. Once the method has been applied to all aircraft, the method illustrated in FIG. 18 continues to step 1808. Alternatively, the method illustrated in FIG. 19 may only be applied to certain aircraft. For example, if at step 1808 a set of aircraft with changed predicted trajectories are identified, the method illustrated in FIG. 19 may only be applied considering each of the aircraft in that set as aircraft X in turn.

The steps illustrated in FIG. 19 may be carried out in an alternative order whilst achieving the same result. For example, steps 1916 and 1918 may be carried out before steps 1911, 1912 and 1914 (that is, the vertical separation could be considered before the time separation).

Also, while FIG. 19 shows an example where the time separation is only determined for pairs of aircraft X, Y which are predicted to occupy their conflict paths simultaneously (step 1911), in other examples the time separation could also be determined for aircraft not predicted to occupy their conflict paths simultaneously (as an indication of the buffer by which the timings would have to change in order for potential loss of separation to arise).

FIG. 20 is a flow diagram illustrating a method of identifying one or more conflict paths. This method can be performed ahead of time, to establish a conflict path database which specifies which conflict paths arise for respective pairs of flight routes.

At step 2002 it is determined whether a new flight route has been created. When the method is run for the first time, all flight routes will be determined as being new flight routes. On subsequent runs of the method, only those flight routes which have not been previously analysed are determined as being new. If it is determined that a new flight route has been created, the method continues to step 2006. If it is determined that no new flight route have been created the method continues to step 2004. At step 2004 it is determined whether any flight routes have been updated. If a flight route has been updated then the method continues to step 2006. If no flight routes have been updated then the method ends.

At step 2006 flight route pairs are identified. Flight route pairs may be identified by pairing each flight route with every other flight route to create a list of flight route pairs. Flight route pairs may also be identified by retrieving a list of flight routes pairs from a database. The method then continues to step 2008. A flight route may comprise a series of one or more zero width routes. Alternatively, a flight route may comprise a series of one or more corridors in the horizontal axis around the nominal flight route.

At step 2008 the flight routes are compared for each pair of flight routes. The method then continues to step 2010 where the horizontal separation between each pair of flight routes is determined.

At step 2012 it is determined whether the horizontal separation between each pair of flight routes is greater than a predetermined horizontal distance. If the horizontal separation between each pair of flight routes is greater than a predetermined horizontal distance then the method continues to step 2014. At step 2014, a record indicating that there are no conflict paths of the flight route pairs is created and the method ends. If the horizontal separation between each pair of flight routes is greater than a predetermined horizontal distance then the method continues to step 2016. At step 2016, the conflict paths for each pair of flight routes are stored and the method returns to step 2006. The conflict paths may be stored in a database to be accessed by another part of the method or another method, for example at step 1802 of the method illustrated in FIG. 18. The database may specify one or more conflict paths for each pair of flight routes.

The method illustrated in FIG. 20 may be run considering an individual flight route and then repeated for every other flight route or the method may be run once considering all flight routes. The method may be repeated whenever a new flight route is created or whenever a flight route is updated. The method may also be configured to run periodically, for example once per hour or once per day.

Alternatively, steps 2006 to 2016 could be performed instead as part of step 1804 of FIG. 18 to identify the conflict paths by comparing horizontal positions of the identified flight routes at the time of performing the conflict detection.

Some embodiments could also combine these two techniques a database of some flight routes and their corresponding conflict paths could be maintained as in FIG. 20 and looked up in step 1804 of FIG. 18, but for flight routes not in the database, additional comparison of the horizontal position of such flight routes with other flight routes can be performed on the fly during step 1804 of the conflict detection method.

A method of detecting conflicts between aircraft may be implemented by one or more computers. A computer program may be provided for controlling a computer to perform a method of detecting conflicts between aircraft. A computer program may also be provided for controlling a computer to identify conflict paths. A computer readable storage medium may also be provided for storing the computer program. The computer readable storage medium may be non-transitory. A computer program product may also be provided for controlling a computer to perform a method of detecting conflicts between aircraft or to identify conflict paths.

Figure 21:
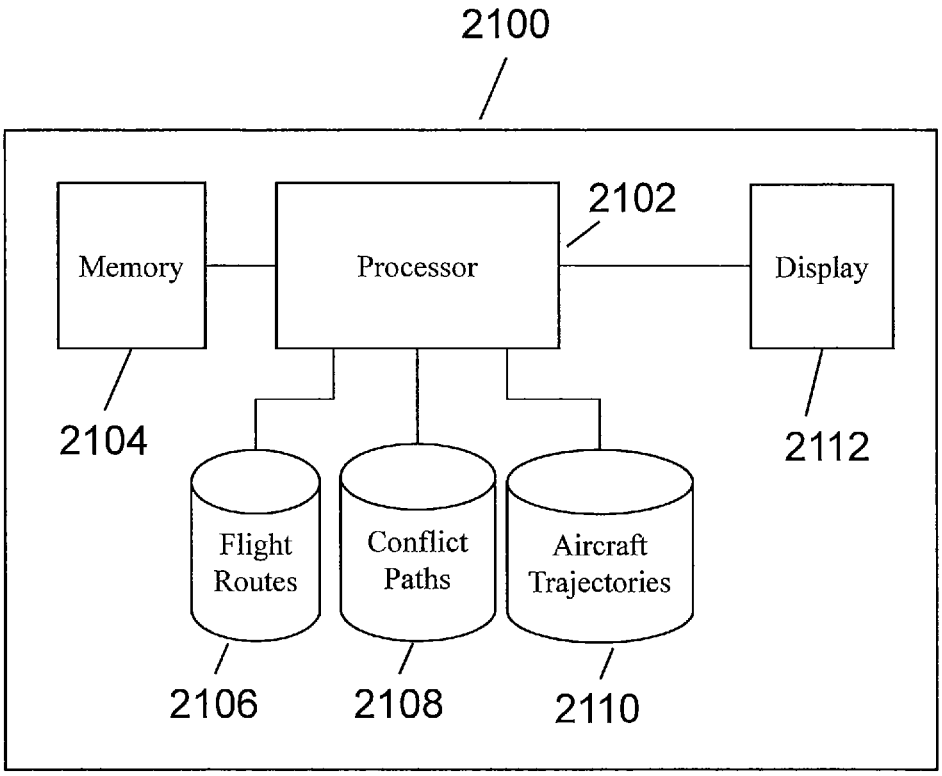
FIG. 21 is a schematic diagram of an example of an air traffic control system.

FIG. 21 illustrates an example of an air traffic control system which can be used to perform the methods shown above. System 2100 comprises a processor 2102 and memory 2104 for controlling the processor to perform a method of detecting conflicts between aircraft or identifying conflict paths. Processor 2102 may be a single or multi-core processor. Processor 2102 may be any form of processing circuitry, for example a number of parallel units. Memory 2104 may be a data store for storing instructions for controlling the processor 2102.

System 2100 also comprises a database of flight routes 2106, a database of conflict paths 2108 and a database of aircraft trajectories 2110. These databases may be in separate locations or remote from the processor and linked via a network. While the databases 2106, 2108, 2110 are shown as separate in FIG. 21, in other examples they may be different parts of a common database. The flight route database 2106 identifies for each flight route the horizontal position of the flight routes (e.g. specifying latitude and longitude coordinates for the start and end points of the route and optionally one or more intervening waypoints). The flight route database 2106 can be accessed in the method of FIG. 20 to compare the flight routes and identify the conflict paths based on which parts of the flight routes have a horizontal separation smaller than a threshold distance.

The conflict path database 2108 records, for one or more respective pairs of flight routes, the conflict paths which arise along these flight routes.

The aircraft trajectory database 2110 specifies, for each aircraft being considered in the conflict detection, the predicted trajectory for that aircraft. The aircraft trajectory database 2110 may also indicate which of the flight routes from the flight route database 2106 the aircraft is following. Hence, by accessing the aircraft trajectory database 2110, the processor can identify which flight routes are active (step 1802 of FIG. 18), and then by looking up each pair of flight routes in the conflict path database 2108, the processor 2102 can identify the conflict paths and hence the hazarding pairs of aircraft, and then can perform the conflict detection using the portions of the trajectories in the trajectory database 2110 that correspond to positions within the conflict paths for hazarding pairs of aircraft (steps 1804 and 1806 of FIG. 18).

System 2100 also comprises a display 2112, such as a computer monitor or an LCD display. System 2100 may also include other components not illustrated in FIG. 21.

The following paragraphs describe a specific example of a method of conflict detection.

An air traffic control (ATC) system is responsible for assuring the safe and expeditious movement of air traffic through its airspace and contiguous areas. It does so by assuring that all aircraft are separated from each other at all times.

Pairs of aircraft are deemed to be separated if the distance between them does not violate a set of predetermined proximity tests. If the proximity tests are violated then the aircraft are deemed to be in conflict.

An ATC system creates a trajectory for each aircraft. An aircraft trajectory contains predicted future positions of the aircraft. An aircraft trajectory is a time ordered sequence of four-dimensional predictions of when and where the aircraft will be during a flight. The dimensions are:

Horizontal Position

Time

Altitude

Of these three categories, the Horizontal Position is the best defined and the least volatile.

Trajectory positions are the nominal predicted positions of the aircraft. There is an element of uncertainty in all of the dimensions. As such, there are tolerances corresponding to a predefined level of confidence for each dimension. These uncertainties may be recorded with each position as:

an across-track uncertainty an along-track uncertainty a time range an altitude range.

The accuracy of the conflict detector is dependent upon the accuracy of the trajectories. To ensure that the most accurate trajectories are used they are frequently updated (usually with every radar sweep), requiring the conflict detector to be updated frequently too.

An aircraft intending to fly through controlled airspace is required to file a flight plan. The flight plan includes the route that the aircraft intending to fly. This is known as the filed flight route 100 (see FIG. 1).

The filed flight route contains the departure 102 and destination airports 104. It may also contain a Standard Instrument Departure (SID), a Standard Terminal Arrival Route (STAR) and multiple airways and waypoints 106-1, 106-2, 106-3. The SID, STAR and airways can be expanded to produce a flight route listing all of the waypoints 106-1, 106-2, 106-3 between the departure 102 and destination 104.

Since the Conflict Detector is only concerned with en-route conflicts, it does not need to consider the route of a flight between and airport and its departure fix (i.e. along a STAR) nor between an arrival fix and its airport (i.e. along a SID).

An aircraft is required to fly its flight route 100 within navigation tolerances defined by Eurocae ED-75C MASPS, Required Navigation Performance for Area Navigation. An aircraft meeting the required navigation performance will remain within the confines of the RNP RNAV airspace with a predefined level of confidence. For example, Basic RNAV (RNP 5) requires the aircraft to be within 5 Nautical Miles of the centreline of a flight route 100 for over 95% of the time.

The MASPS also define the navigation tolerances as an aircraft transitions from one flight route leg to another. Within en-route airspace, an aircraft is required to perform a "fly-by" turn prior to reaching each waypoint.

A flight route 100 of an aircraft together with the navigation tolerances of the aircraft define a horizontal path that the aircraft is required to be within to a predefined level of confidence. This is known as the flight path 200 for an aircraft (see FIG. 2).

An aircraft flying in controlled airspace is required to fly its filed flight route 100, unless instructed otherwise by ATC. These types of ATC instructions come in two forms:

Route Direct Instructions;

Heading Instructions.

ATC may instruct an aircraft to fly directly to a position, or a sequence of positions, in which case the aircraft is required to turn off its current flight route towards the first given position. The last position in the sequence should be a position on the current flight route 100 so that the aircraft can rejoin it.

A route direct instruction changes the flight route 100 that the aircraft is currently cleared to fly. The aircraft is required to fly the new flight route to the same navigation tolerances as its filed flight route.

ATC may instruct an aircraft to fly on a magnetic heading, or to fly to the left or right of the current heading by a number of degrees. In either case, the aircraft is required to turn off its current flight route 100 onto the new heading.

Heading instructions are short term tactical instructions used to avoid conflicts. ATC are expected to instruct the aircraft to rejoin the flight route by issuing a route direct instruction when practicable. A heading instruction allows an aircraft to deviate from its cleared flight route 100 in the short term.

In a tactical (short term) system, a Trajectory Predictor generates a trajectory based upon the heading instruction. However, for a planning (long term) system, the Trajectory Predictor should continue to generate trajectories based upon the cleared route but with additional uncertainty to its estimated times to account for the uncertainty on when the aircraft will be instructed to rejoin the cleared flight route 100.

The Estimated Time Over (ETO) a given en-route point or the Estimated Time of Arrival (ETA) at the destination are calculated from:

the departure time;
the distances between route points;
the performance of the aircraft;
the altitude of the aircraft;
the forecast air temperature;
the forecast wind speed and direction.

The accuracy of the estimated times depends upon the accuracy of the all of these factors.

An aircraft in level flight in controlled airspace is required to fly within 200 feet of the last cleared level issued by ATC. It is not so constrained whilst it is climbing or descending, when its altitude depends upon:

the forecast air temperature;
the mass of the aircraft mass;
the available performance of the aircraft;
how the aircraft is being flown.

The accuracy of the predicted altitudes depends upon the accuracy of the all of these factors.

The dimensions of aircraft trajectory positions can be divided into three categories: horizontal position, time and altitude. Of these three categories, the horizontal position is the best defined and least volatile. The filed flight route 100 and MASPS together enable a flight path 200 to be defined for a flight. Although the precise position of the aircraft is unknown, it will be somewhere within the confines of its flight path 200. Unlike the trajectory, which may change with every radar sweep, the flight route 100 and hence the flight path 200 are relatively constant.

The conflict detection algorithm finds a conflict between a pair of aircraft by considering the different ways that the aircraft can interact:

1) Is the separation of the flight paths assured? If not, create corresponding conflict paths.
2) Has one of the flights passed its corresponding conflict path? If not, calculate the time separation and the vertical separation.
3) Can the time separation and vertical separation be lost simultaneously?

Unless the answer to all three questions is no, then the separation of the aircraft can be assured.

An aircraft is required to fly its flight route 100 to a given navigation performance. A flight path 200 is a two-dimensional polygon created by sweeping the navigation performance for an aircraft confidence limits along the flight route 100 of the aircraft. The minimum distance between of a pair of flight paths is the minimum distance between the polygons of the flight paths.

$$d_{min} > d_{threshold} \quad \text{Eq. 1}$$

If the minimum distance between the flight paths is greater than the separation threshold (Eq. 1), as illustrated in FIG. 3, then the separation of the aircraft can be assured. If the minimum distance between the flight paths is not greater than the separation threshold, as illustrated in FIG. 4, then separation of the aircraft cannot be assured in the parts of the flight paths where the distance between them is within the separation threshold (Eq. 2). These are the conflict paths.

$$d_{min} < d_{threshold} \quad \text{Eq. 2}$$

The ends of the conflict paths are the first and last points along each flight path where the distance to the other path is within the separation threshold (Eq. 2). The conflict paths will be normally be separated by the separation threshold at their ends. However, there are circumstances where this may not be so. For example when two routes start and/or end at the same points.

The conflict paths are created from the flight routes of the aircraft, independently of the predicted trajectories of the aircraft. The conflict paths only need to be re-created when a flight route of an aircraft changes, not when a trajectory of an aircraft is updated. Where the separation of a pair of flight paths is not assured, their separation in the parts of the flight paths outside of the conflict paths can be assured.

The trajectories are also created from the aircraft flight routes. The trajectories of pending flights will cover the whole of the flight route whilst the trajectories of active flights normally start at the last known position of the aircraft. The trajectory positions contain the times and altitudes that the aircraft is predicted to occupy as it flies the flight route. Therefore by finding the trajectory positions corresponding to the start and end of the conflict paths, the trajectory of each aircraft whilst the aircraft is in a corresponding conflict path can be determined.

The trajectory of an active flight that has flown past the end of a corresponding conflict path will not contain any positions corresponding to the conflict path. However, since the active flight has passed the corresponding conflict path, the separation of the active flight can be assured (see FIG. 5 or 6 for example). The trajectory of an active flight that has passed the start of a conflict path will not contain the start position, so the first trajectory position is used instead.

Figure 7:
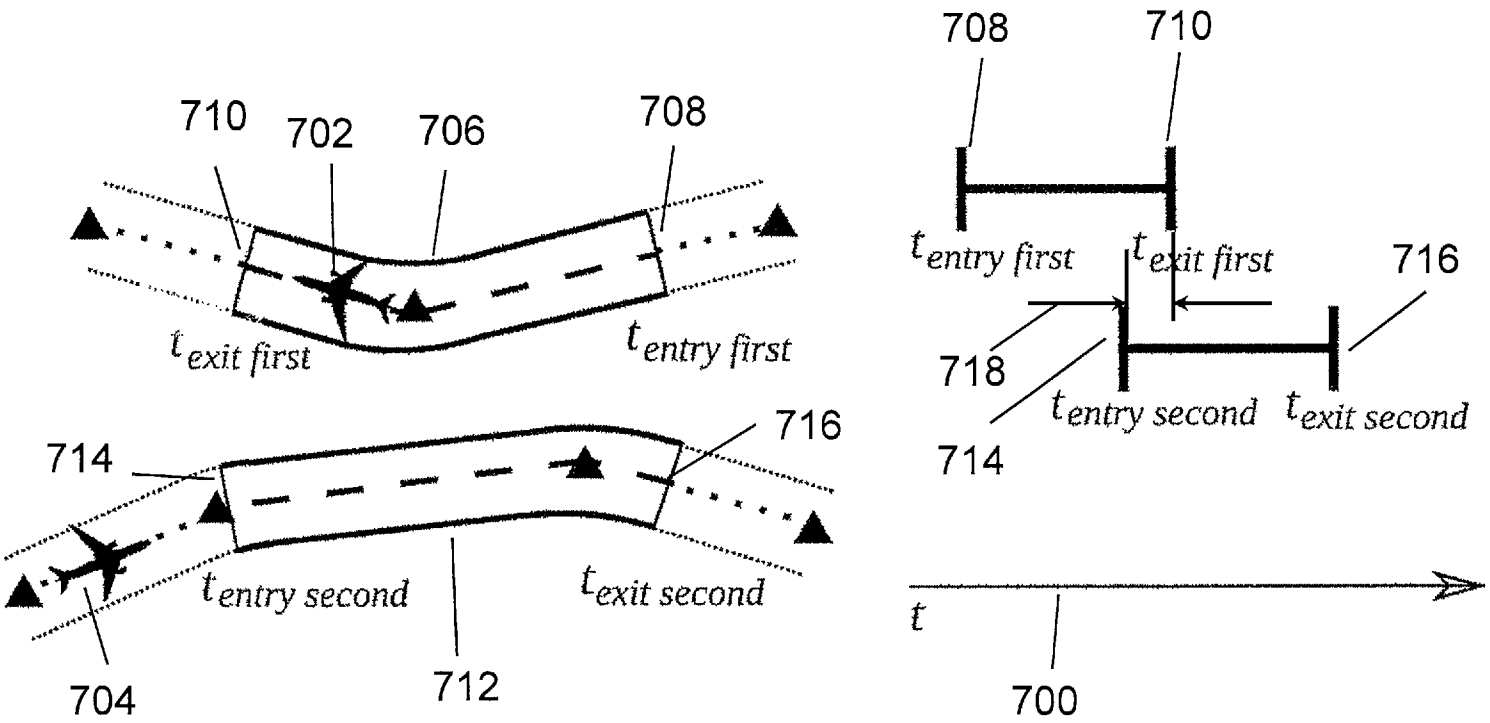
FIG. 7 is a schematic diagram of a hazarding pair of aircraft flying in opposing directions which occupy their corresponding hazarding conflict paths at common times.

Whilst a pair of aircraft are located within corresponding conflict paths, the separation of the aircraft may not be assured. However, it is only the across-track separation of the aircraft that may be lost in the conflict paths. The horizontal separation of a pair of aircraft can be assured if the aircraft cannot occupy corresponding conflict paths simultaneously (e.g. see FIG. 6). However, if both aircraft can be in corresponding conflict paths at the same time then the horizontal separation of the aircraft may not be assured, as illustrated in FIG. 7.

The time when both aircraft can occupy corresponding conflict paths simultaneously is the common period. The start of the common period is the earliest time that the second aircraft is predicted to enter its conflict path:

$$t_{common\ start} = t_{entry\ second} \quad \text{Eq. 3}$$

The end of the common period is the latest time of the first aircraft to exit its conflict path:

$$t_{common\ finish} = t_{exit\ first} \quad \text{Eq. 4}$$

The duration of the common period is simply the difference between the start time and the finish time:

$$t_{duration} = t_{common\ finish} - t_{common\ start} \quad \text{Eq. 5}$$

A positive duration is the length of the period when the aircraft may simultaneously occupy their corresponding conflict paths. A negative duration is a measure of the horizontal separation of the aircraft.

For a pair of aircraft flying in the same direction, their separation can be assured if they cannot occupy their conflict paths simultaneously and the conflict path of the leading aircraft is longer than the horizontal separation threshold.

The along track separation of a pair of aircraft will be at a minimum when the aircraft pass each other (see FIG. 8).

The time when the aircraft are predicted to pass each other depends upon the relative direction and speed of the aircraft.

If the aircraft approach each other head-on and the duration of the common period is negative, then the aircraft are not predicted to pass each other in corresponding conflict paths and so separation of the aircraft can be assured. The separation time of the aircraft is simply the negation of the common period duration:

$$t_{head\ on\ separation}=-t_{duration} \quad \text{Eq. 6}$$

If the aircraft are flying in the same direction, known as in-trail (e.g. see FIG. 9), then whether the aircraft can lose separation depends upon the relative speed of the aircraft:

$$\Delta S=S_{trailing}-S_{leading} \quad \text{Eq. 7}$$

If the first aircraft to enter a conflict path is flying faster than or flying at the same speed as the trailing aircraft, then separation of the aircraft can be assured if the aircraft are separated when the aircraft enter the corresponding conflict paths, i.e. if the leading aircraft is more than the along track separation distance ahead of the trailing aircraft when the trailing aircraft enters a conflict path:

$$t_{along\ track\ separation}=d_{along\ track}/S_{leading} \quad \text{Eq 8}$$

The separation time between the aircraft depends upon difference in the conflict path entry times of the aircraft:

$$t_{slower\ trailing\ separation}=\Delta t_{entry}-t_{along\ track\ separation} \quad \text{Eq 9}$$

If the first aircraft to enter a conflict path is flying slower than the trailing aircraft and exits the conflict path before the trailing aircraft, then the separation time depends upon the difference in the exit times of the aircraft:

$$t_{faster\ trailing\ separation}=\Delta t_{exit}-t_{along\ track\ separation} \quad \text{Eq 10}$$

If the second aircraft to enter a conflict path passes the first aircraft whilst both aircraft are in corresponding conflict paths then the time separation will be the smaller of the times from Eq. 9 and Eq. 10.

A positive separation time is the time buffer before a potential loss of separation cannot be assured. A negative separation time is a measure of the minimum change in trajectory times required for a potential loss of separation to be assured. The separation times should increase with time as the trajectories are updated because the time uncertainty at each trajectory position decreases with each trajectory update. A decrease in the separation times indicates errors in the speeds of one or both of the trajectories.

In the worst case, these errors may cause a pair of aircraft that were deemed separated to lose separation. For example, when the aircraft approach each other head on, if the second aircraft enters a conflict path earlier and/or the first aircraft exits a corresponding conflict path later than predicted then an undetected loss of separation will occur. By monitoring the separation time over time, significant errors in trajectory velocities can be observed together with the effect on aircraft interactions. Monitoring the interaction separation times should enable the conflict detector to detect and account for forecast wind errors.

If the aircraft approach each other head-on then, assuming that the aircraft are travelling at a constant speed, the times that the aircraft are predicted to lose and regain separation depend upon when the aircraft are predicted to pass each other and the time taken for the aircraft to cover the along track separation distance between the aircraft:

$$t_{pass} \approx t_{common\ finish} - t_{duration}/2 \quad \text{Eq 11}$$

$$\Delta s = s_{first} + s_{second} \quad \text{Eq 12}$$

$$\Delta t_{along\ track} = \frac{d_{along\ track}}{\Delta s} \quad \text{Eq 13}$$

So the start and finish of the loss of along track separation period is:

$$t_{along\ track\ loss\ start}=t_{pass}-\Delta t_{along\ track} \quad \text{Eq 14}$$

$$t_{along\ track\ loss\ finish}=t_{pass}+\Delta t_{along\ track} \quad \text{Eq 15}$$

If the aircraft are in-trail then the time when the aircraft lose separation depends upon the relative speed of the aircraft and the separation distance of the aircraft when the aircraft enter the corresponding conflict paths, see Eq. 7 and:

$$\Delta d_{entry}=\Delta t_{entry} s_{leading} \quad \text{Eq 16}$$

The aircraft will lose separation when the entry separation distance has been reduced to the along track separation distance:

$$t_{alongtrack\ loss\ start} = t_{entry\ trailing} + \frac{\Delta d_{entry} - d_{along\ track}}{\Delta s} \quad \text{Eq 17}$$

The aircraft will regain separation when the aircraft are separated by the along track separation distance after passing each other:

$$t_{alongtrack\ lossfinish} = t_{entrytrailing} + \frac{\Delta d_{entry} + d_{along\ track}}{\Delta s} \quad \text{Eq 18}$$

The denominator in the equations above can be tested to avoid divide by zero errors. If $\Delta s<=0$ in Eq. 17 then the aircraft may not lose separation and if $\Delta s<=0$ in Eq. 18 then the aircraft may not regain separation.

To lose horizontal separation, the aircraft must lose both along-track and across track separation simultaneously. They must therefore lose along-track separation during the common period whilst both aircraft are flying through the corresponding conflict paths:

$$t_{LHS\ start}=\max(t_{common\ start}, t_{along\ track\ loss\ start}) \quad \text{Eq 19}$$

$$t_{LHS\ finish}=\min(t_{common\ finish}, t_{along\ track\ loss\ finish}) \quad \text{Eq 20}$$

The vertical separation of the aircraft depends upon the ranges of altitudes that the aircraft can occupy whilst the aircraft are in corresponding conflict paths. It is only necessary to consider the altitudes that the aircraft can occupy whilst they are in their conflict paths (see FIGS. 10 and 11). If the altitude ranges of the aircraft are not predicted to breach the vertical separation threshold then the vertical separation of the aircraft can be assured (FIG. 10), otherwise the vertical separation of the aircraft may not be assured (FIG. 11).

The intersection of the ranges of altitudes that both aircraft may occupy in corresponding conflict paths is the range of common altitudes. A positive or zero range is the size of the common altitudes that both aircraft may occupy whilst the aircraft are in corresponding conflict paths. A negative range is a measure of the vertical separation of the aircraft.

$$alt_{common\ range}=alt_{common\ high}-alt_{common\ low} \quad \text{Eq 21}$$

where $alt_{common\ high}$ is the lower of $alt_{high\ first}$ and $alt_{high\ second}$, and $alt_{common\ low}$ is the higher of $alt_{low\ first}$ and $alt_{low\ second}$ If the magnitude of a negative range is greater than the vertical separation threshold then the separation of the aircraft is assured. Otherwise the aircraft may be still separated depending upon their altitude separation through the conflict paths.

The minimum value of the altitude separation is the separation altitude. If both aircraft are in level flight through their conflict paths then their separation altitude is simply the negation of the common altitude range.

$$alt_{separation}=-alt_{common\ range} \quad \text{Eq 22}$$

If the separation altitude is greater than (or equal to) the vertical separation threshold the vertical separation can be assured. Otherwise, if one or both aircraft are climbing or descending through their conflict paths, the separation altitude is calculated from the minimum value of their altitude separation through the conflict paths.

$$alt_{separation}=-alt_{min} \quad \text{Eq 23}$$

The separation altitude of aircraft that are climbing or descending through their conflict paths may be greater than the value from Eq 22 (see FIGS. 12 and 13).

If the aircraft cannot occupy the conflict paths at the same time then their time separation may be assured. However if their separation time is small, an estimate of their separation altitude may be required to determine whether the aircraft could potentially lose overall separation. In this case the separation altitude may be calculated from the altitude range of the first aircraft when it leaves its conflict path and the altitude range of the other aircraft when it enters its conflict path.

If the separation altitude of the aircraft is less than the vertical separation threshold the vertical separation of the aircraft cannot be assured. The period whilst the vertical separation of the aircraft cannot be assured is the earliest time when vertical separation may be lost to the last time when vertical separation may be restored, If both aircraft are in level flight then this is the common period from $t_{common\ start}$ to $t_{common\ finish}$ discussed above. Otherwise the times when vertical separation may be lost and regained are determined by comparing the trajectory altitudes at common times over the common period.

The overall separation of a pair of aircraft can be assured if they are not predicted to occupy their conflict paths at the same time or if they are vertically separated, i.e. their separation time is positive and/or their separation altitude is greater than (or equal to) the vertical separation threshold. To lose overall separation their separation time must be negative and their separation altitude must be less than the vertical separation threshold.

Furthermore, the aircraft must lose both horizontal and vertical separation simultaneously.

If they cannot lose horizontal and vertical separation simultaneously then their separation can be assured.

$$t_{over\ all\ start}=\max(t_{horizontal\ start}, t_{vertical\ start}) \quad \text{Eq 24}$$

$$t_{overall\ finish}=\min(t_{horizontal\ finish}, t_{vertical\ finish}) \quad \text{Eq 25}$$

The earliest time that the aircraft may lose overall separation is the start of the overall loss of separation period:

$$t_{loss\ of\ separation}=t_{overall\ separation\ start} \quad \text{Eq 26}$$

In summary, by using the flight routes of aircraft instead of the trajectories of aircraft in the initial search for conflicts, the conflict detector is able to filter out combinations of aircraft whose separation can be assured, regardless of any changes in trajectories of the aircraft. Furthermore, for combinations of aircraft whose separation cannot be assured, the conflict detector calculates the sections of the flight routes, known as conflict paths, where the separation of the aircraft may be lost. The separation of the aircraft can be assured if the aircraft cannot both occupy corresponding conflict paths at the same time or if the altitudes of the aircraft are separated. As such, the separation of the trajectories of aircraft can be assured with a pair of simple comparisons. Using the routes to find conflicts in this way provides the following benefits:

- The conflict paths only need to be found when a new flight is received or an existing flight's route is changed.
- Once the conflict paths have been found, the number of trajectory combinations to be considered is reduced.
- The separation of the aircraft can be assured by simply comparing the times and altitudes that the aircraft may occupy whilst in their conflict paths.
- The conflict paths enable the time and altitude by which aircraft are separated or in conflict to be calculated.
- Monitoring separation times enables the effect of trajectory prediction errors to be considered.
- The separation times and altitudes enables the effect of changing trajectory times and/or altitudes to be considered on the interactions involving a pair of aircraft.

Figure 26:
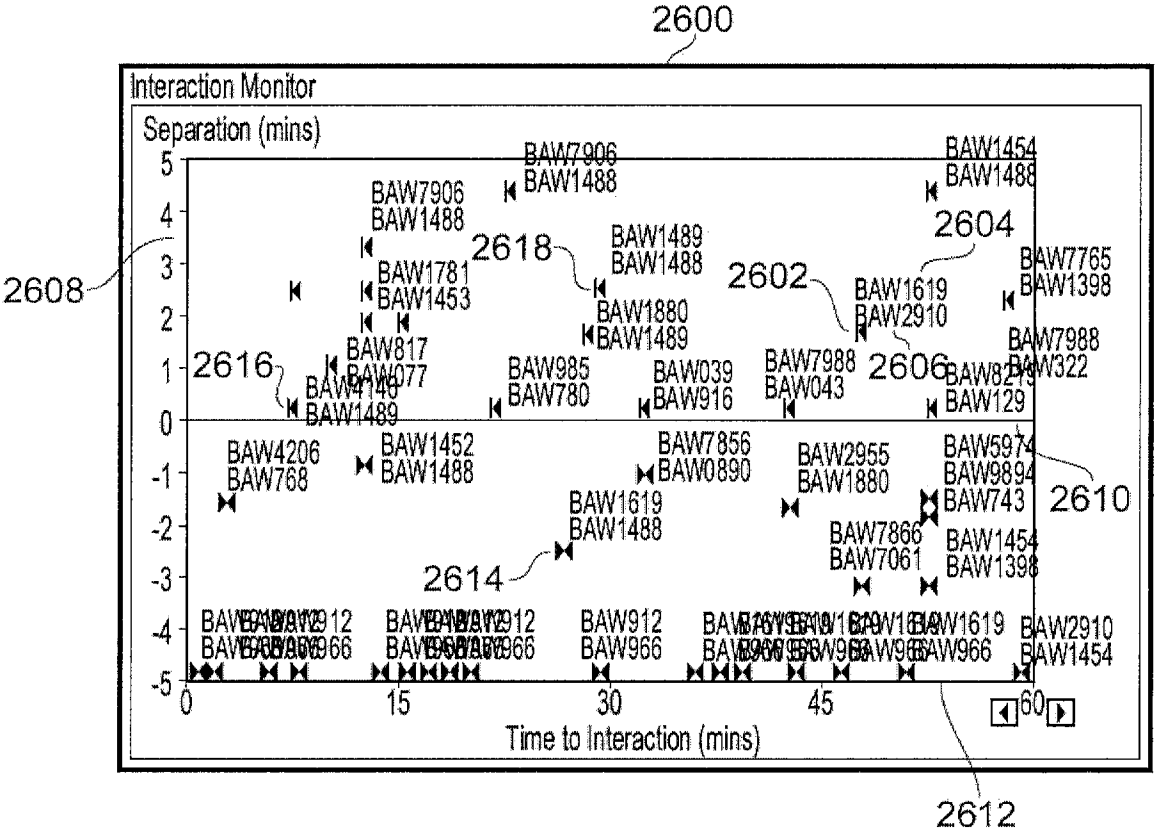
FIG. 26 is a schematic diagram of an interaction display.

An Interaction Monitor may be used to display the interactions found by the Conflict Detector. The Conflict Detector is an HTTP Server. As such, the Interaction Monitor obtains interactions from the Conflict Detector by sending the Conflict Detector HTTP requests at regular intervals. If the Conflict Detector does not respond to the requests from the Interaction Monitor within a given time then the Interaction Monitor shall indicate that the connection to the Conflict Detector is lost. The Interaction Monitor may also interface to an external clock to synchronise its time with the rest of the system. Whenever the Interaction Monitor is active it sends HTTP GET or interactions requests to the Conflict Detector. If the Conflict Detector responds the Interaction Monitor updates an interaction display with the new data. FIG. 26 illustrates an example of an interaction display 2600. If the Conflict Detector does not respond then the Interaction Monitor indicates that the Conflict Detector is disconnected and does not change the interaction display.

Figure 27:
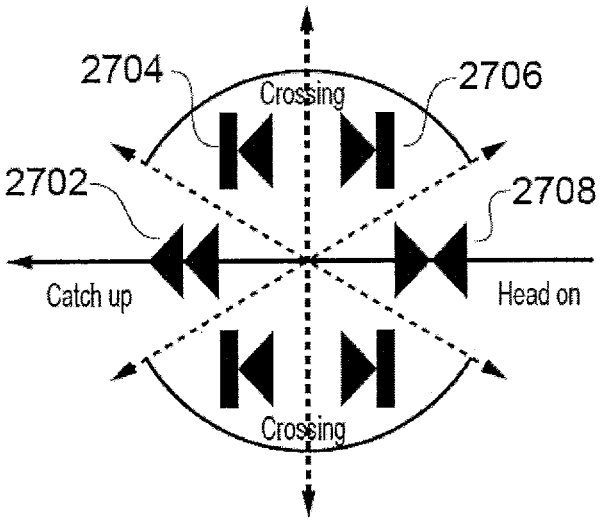
FIG. 27 is a schematic diagram of different symbols used on the interaction display.

The relative direction of the aircraft through conflict paths determines interaction geometries and symbols 2602 used to show the interactions. FIG. 27 illustrates example of different symbols that may be used. The interaction geometry and symbols can be one of:

- Catch-up 2702—conflict path relative angle<=30°;
- Catch-up crossing 2704—30°<conflict path relative angle<90°;
- Head-on crossing 2706—90°<=conflict path relative angle<150°;
- Head-on 2708—150°<=conflict path relative angle.

The callsigns 2604, 2606 of the interacting aircraft are displayed with the interaction geometry symbol. The callsign of the leading aircraft 2604 is displayed above the callsign of the trailing aircraft 2606.

The time (in minutes) by which the separation of the aircraft can be assured is displayed on the y axis 2608 of the interaction display. If the Interaction Geometry symbol is above the zero line 2610 then the separation of the aircraft is assured. If the Interaction Geometry symbol is below the zero line 2610 then the separation of the aircraft may not be assured. For head-on interactions, the separation time is the period between the leading aircraft leaving a conflict path and the trailing aircraft entering a corresponding conflict path. For catch-up interactions, a positive separation time is the difference in the aircraft conflict path entry or exit times, which ever is the smaller. A negative separation time is the period during which the separation may not be assured. If the trailing aircraft is catching up the leading aircraft on the same route with a small speed difference, the period during which the separation may not be assured can be very long, so the period is clamped to the minimum displayed separation time.

The time to interaction (in minutes or hours) is displayed on the x axis 2612 of the interaction display. For a pair of aircraft with an Interaction Geometry symbol located below the zero line 2610, the location of the Interaction Geometry symbol on the x axis represents the period remaining before the aircraft may lose assured separation. The time to interaction will decrease overtime, i.e. the Interaction symbols will move to the left.

The calculated separation time of the aircraft determines the colour of the interaction symbol. The calculated separation time is an estimate of the separation time of the aircraft when the Time to Interaction is zero. The calculated separation time is determined from the current separation time and a number of recent separation times. As such, the calculated separation time takes into account the rate of change of separation time with time. The Interaction colour can be one of:

red 2614—the calculated separation time is less than zero, the separation of the aircraft may not be assured;

amber 2616—the calculated separation time is less than 60 seconds;

green 2618—the calculated separation time is greater than 60 seconds.

Interaction symbols below the zero line 2610 may have green or amber symbols for aircraft that are flying well within the predicted trajectory timings. This should be quite a common occurrence. Interaction symbols above the zero line 2610 may have red symbols where one or both of the aircraft is flying ahead or behind of the predicted trajectory times. This should be rare as it indicates a significant trajectory speed error.

Figure 22:
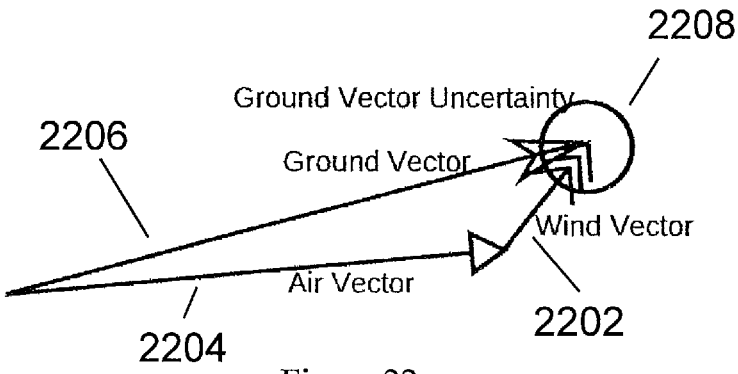
FIGS. 22 to 25 are vector diagrams of velocities for an aircraft.

The accuracy of the trajectory of an aircraft is determined by a number of factors. One of the most significant of which is the accuracy of the forecast wind speed and direction. As illustrated in FIG. 22, the trajectory of an aircraft is predicted by adding the forecast wind vector 2202, comprising the wind speed and direction, to the air vector of the aircraft 2004, comprising the air speed and heading, to determine the ground vector 2206 of the aircraft comprising ground speed and ground track. In the case of a heading trajectory, the ground vector is simply the sum of the air vector and the forecast wind vector.

For a trajectory following a flight route, the aircraft will change heading to maintain a ground track so that the aircraft does not deviate from the flight route. Therefore the wind will simply act as a head wind or a tail wind, slowing down or speeding up the aircraft respectively.

Figure 23:
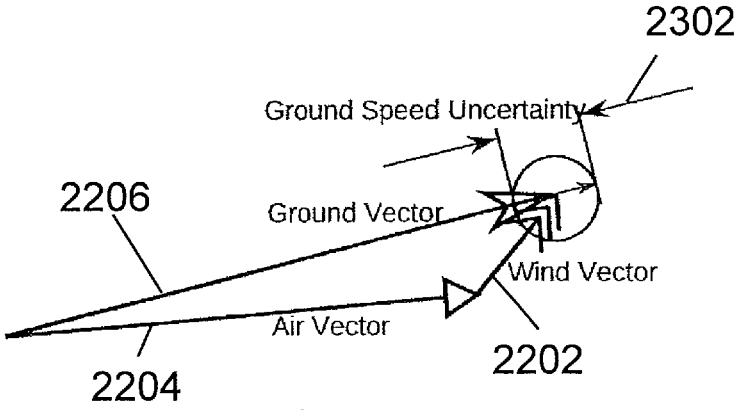
Figure 24:
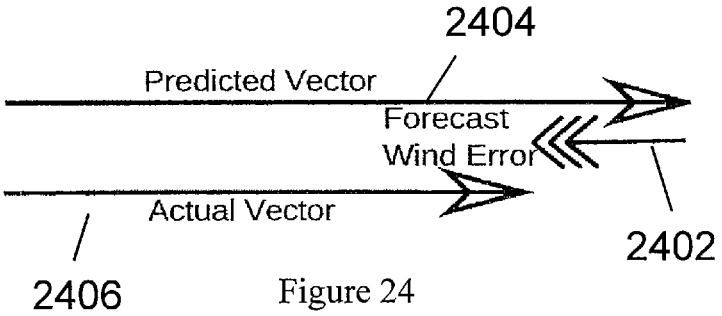
Figure 25:
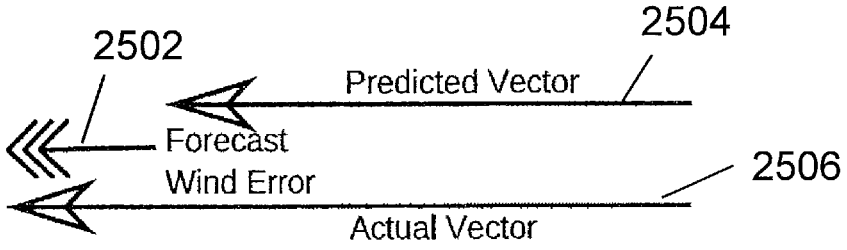

Errors in the forecast wind speed and/or direction create in errors in the predicted trajectories. The wind error can be modelled as a circle of uncertainty 2208 around the wind vector 2202. The effect of forecast wind uncertainty on a heading trajectory is to create uncertainty in the position. For a trajectory following a flight route the wind error creates uncertainty in the ground speed 2302 as illustrated in FIG. 23. The precise effect of forecast wind error on a trajectory depends upon the relative direction of the wind error vector and the ground track of the trajectory. Where the wind error 2402 acts as a head wind, as illustrated in FIG. 24 it can be subtracted from the ground speed of the trajectory 2404 to calculate the actual ground speed of the aircraft 2206. Where the wind error 2502 acts as a tail wind, as illustrated in FIG. 25, it can be added to the ground speed of the trajectory 2504 to calculate the actual ground speed of the aircraft 2506.

The effect of forecast wind error on conflict detection depends upon the relative direction of the aircraft and the forecast wind error. If the trajectories are heading in the same direction, then the effect of a forecast wind error will be roughly the same for both trajectories, regardless of whether it is a head wind or a tail wind. Both aircraft will arrive either later or earlier than predicted by approximately the same amount. This may introduce an error in the estimated loss of separation time, but this error will not affect whether a loss of separation is detected or not.

However, if the trajectories are heading in the opposite direction, then any wind error has the opposite effect on each trajectory. For example a headwind for one trajectory is a tailwind for the other trajectory and vice versa. One aircraft will arrive later than predicted, whilst the other aircraft will arrive earlier than predicted. So an error in the forecast wind may not just introduce an error in the estimated loss of separation time, it could cause a loss of separation to be overlooked.

One of the concepts of Single European Sky ATM Research (SESAR) is for each aircraft to predict a trajectory which it is then required to fly to. For example, the aircraft is required to fly to meet the ETOs in the predicted trajectory. For an aircraft to meet the ETOs in the predicted trajectory, the aircraft must fly at the ground speed used to predict the ETOs. An aircraft with a modern 4D Flight Management System (FMS) can alter the air speed of the aircraft to compensate for small wind speed errors to maintain a ground speed and so achieve the ETOs. However if an aircraft, even one equipped with a 4D-FMS, is flying at a cruising altitude then the flight envelope of the aircraft is very small. For example an aircraft flying at a cruising altitude can only fly over small speed range. Therefore the 4D-FMS does not have much scope to change the air speed of the aircraft in order to achieve the ETOs. So the aircraft may not be able to meet all of its required ETOs if there are significant errors in the forecast wind.

The maximum altitude of an aircraft depends upon the mass of the aircraft. As an aircraft flies it burns fuel, reducing its mass and increasing its maximum altitude. In a cruise climb the aircraft gradually climbs as its mass decreases. A cruise climb is the most efficient way for an aircraft to fly. However, the flight envelope of an aircraft would be even smaller if the aircraft were permitted to cruise climb, further reducing the scope of an aircraft FMS to meet required ETOs if there are errors in the forecast wind.

In summary, a method for detecting conflicts between aircraft flying in controlled airspace is described. The method determines whether pairs of aircraft flight routes violate a predetermined proximity test. The separation of pairs of aircraft whose flight routes do not violate the proximity test is assured. For pairs of aircraft whose flight routes violate the proximity test, the method calculates the parts of their flight routes that breach the separation threshold, the conflict paths 406, 408. The conflict paths are stored. The method determines the portions of aircraft trajectories corresponding to the conflict paths. The separation of aircraft that have flown past their conflict paths is assured. The separation time and separation altitude of pairs of aircraft that have not flown past their conflict paths are calculated. The separation time and separation altitude are used to determine future circumstances whereby the pairs of aircraft may lose separation.

The skilled person will appreciate that these embodiments are provided only by way of example, and different features from different embodiments can be combined as appropriate. Although illustrative embodiments of the invention have been described in detail herein with reference to the accompanying drawings, it is to be understood that the invention is not limited to those precise embodiments, and that various changes and modifications can be effected therein by one skilled in the art without departing from the scope of the invention as defined by the appended claims.

The invention claimed is:

1. A computer implemented method for detecting conflicts between a plurality of aircraft, the method comprising:

identifying flight routes for the plurality of aircraft, wherein each flight route comprises a routing of a flight of an aircraft accounting for latitudinal and longitudinal positions of the aircraft without accounting for time;

based on the identified flight routes, identifying start and end points of one or more conflict paths, wherein a conflict path comprises a portion of a flight route which has a horizontal separation from another flight route less than a predetermined horizontal distance; and performing conflict detection using portions of predicted trajectories of the plurality of aircraft corresponding to positions within the one or more conflict paths, each predicted trajectory comprising predicted timings at which an aircraft is predicted to be situated at respective positions;

wherein the conflict paths are identified independent of the predicted trajectories of the aircraft; and for a given predicted trajectory including a portion corresponding to the one or more conflict paths, at least a portion of the given predicted trajectory corresponding to positions outside the one or more conflict paths is eliminated from the conflict detection based on the identifying of the conflict paths using the flight routes.

2. The method of claim 1, wherein identifying the one or more conflict paths comprises comparing horizontal positions of the flight routes.

3. The method of claim 1, wherein identifying the one or more conflict paths comprises looking up pairs of the identified flight routes in a database specifying conflict paths for each pair of flight routes.

4. An air traffic control system comprising:

processing circuitry; and a data store for storing instructions for controlling the processing circuitry to perform the method of claim 1.

5. A non-transitory, computer-readable storage medium storing a computer program for controlling a computer to perform the method of claim 1.

6. The method of claim 1, comprising identifying at least one hazarding pair of aircraft for which the flight routes for that hazarding pair of aircraft have hazarding conflict paths separated by a horizontal separation less than the predetermined horizontal distance.

7. The method of claim 6, comprising determining that a separation requirement is satisfied between a given hazarding pair of aircraft when one of the given hazarding pair of aircraft has traveled beyond a corresponding one of the hazarding conflict paths.

8. The method of claim 6, comprising eliminating the given hazarding pair of aircraft from subsequent conflict detection when one of the given hazarding pair of aircraft has traveled beyond the corresponding one of the hazarding conflict paths.

9. The method of claim 6, wherein the conflict detection comprises comparing predicted timings at which a given hazarding pair of aircraft are expected to be at positions corresponding to the hazarding conflict paths.

10. The method of claim 6, comprising determining that a separation requirement is satisfied between a given pair of hazarding aircraft when the given hazarding pair of aircraft are not expected to occupy the corresponding hazarding conflict paths simultaneously.

11. The method of claim 6, wherein the conflict detection comprises determining, based on the identified conflict paths and the trajectories of a given hazarding pair of aircraft, at least one of:

an earliest time at which separation between the given hazarding pair of aircraft is lost;

and a duration of a period when separation between the given hazarding pair of aircraft is lost.

12. The method of claim 6, wherein the conflict detection comprises determining a vertical separation of the predicted trajectories of a given hazarding pair of aircraft at positions corresponding to the hazarding conflict paths.

13. The method of claim 6, comprising determining a time separation for the given hazarding pair of aircraft based on the predicted timings at which the given hazarding pair of aircraft are expected to be at positions corresponding to the hazarding conflict paths.

14. The method of claim 13, wherein the time separation represents an amount of time by which the predicted timings of one of the hazarding pair of aircraft would need to change to cause or avoid loss of separation.

15. The method of claim 13, comprising determining that a separation requirement is satisfied between the given hazarding pair of aircraft when the time separation is greater than a first predetermined time threshold.

16. The method of claim 13, comprising eliminating the given pair of hazarding aircraft from subsequent conflict detection when the time separation is greater than a first predetermined time threshold.

17. The method of claim 13, comprising outputting a warning indication for the given pair of hazarding aircraft when the time separation is less than a second predetermined time threshold.

18. The method of claim 13, comprising determining a rate of change of the time separation over time.

19. A computer implemented method comprising:

identifying a plurality of aircraft flight routes, wherein each aircraft flight route comprises a routing of a flight of an aircraft accounting for latitudinal and longitudinal positions of the aircraft without accounting for time;

comparing the aircraft flight routes to identify conflict paths, wherein a conflict path comprises a portion of an aircraft flight route which has a horizontal separation from another aircraft flight route less than a predetermined horizontal distance, and wherein the comparing the aircraft flight routes comprises performing, for a given pair of flight routes, a plurality of comparisons comparing horizontal positions of the given pair of flight routes; and storing, for one or more pairs of aircraft flight routes, an indication of whether one or more conflict paths were identified for each pair.

20. A non-transitory, computer-readable storage medium storing a computer program for controlling a computer to perform the method of claim 19.

* * * * *